US009504286B2

(12) United States Patent
Sussmann et al.

(10) Patent No.: US 9,504,286 B2
(45) Date of Patent: Nov. 29, 2016

(54) DECORATIVE HELMET

(71) Applicant: Pop Up Tops Ltd., London (GB)

(72) Inventors: Adrian Edward Sussmann, Brecon (GB); Mark Wayne Plowman, Hartshorne (GB)

(73) Assignee: Pop Up Tops Ltd., London (GB)

( * ) Notice: Subject to any disclaimer, the term of this patent is extended or adjusted under 35 U.S.C. 154(b) by 0 days.

(21) Appl. No.: 14/680,368

(22) Filed: Apr. 7, 2015

(65) Prior Publication Data

US 2016/0143382 A1 May 26, 2016

Related U.S. Application Data

(63) Continuation-in-part of application No. 14/551,593, filed on Nov. 24, 2014, and a continuation-in-part of application No. 29/510,001, filed on Nov. 24, 2014.

(51) Int. Cl.

| | |
|---|---|
| ***A42B 1/00*** | (2006.01) |
| ***A63B 71/10*** | (2006.01) |
| ***A42B 3/00*** | (2006.01) |
| ***A42B 3/04*** | (2006.01) |
| ***A42B 1/20*** | (2006.01) |

(52) U.S. Cl.

CPC ..... *A42B 1/004* (2013.01); *A42B 1/201* (2013.01); *A42B 1/208* (2013.01); *A42B 3/00* (2013.01); *A42B 3/0406* (2013.01); *A63B 71/10* (2013.01)

(58) Field of Classification Search

CPC ..... A63B 71/10; A42B 1/208; A42B 1/201; A42B 1/205; A42B 1/004; A42B 3/00; A42B 3/0406; A41G 7/00

USPC ..... 2/200.3, 200.1, 171, 209.11; D2/870, D2/875; 446/26, 27

See application file for complete search history.

(56) References Cited

U.S. PATENT DOCUMENTS

| | | | | |
|---|---|---|---|---|
| 3,551,911 | A | 1/1971 | Holden | |
| 3,917,153 | A * | 11/1975 | Holschneider | A42B 1/208 229/116.1 |
| D312,915 | S | 12/1990 | Gilfert et al. | |
| 5,214,800 | A | 6/1993 | Braun | |
| 5,328,399 | A | 7/1994 | Reynolds | |
| 5,343,567 | A | 9/1994 | Zumbiel | |
| 5,428,842 | A * | 7/1995 | Wise | A42B 1/208 2/195.1 |
| 5,881,384 | A | 3/1999 | Williams | |
| D417,768 | S | 12/1999 | Siragusa | |
| 6,295,649 | B1 * | 10/2001 | Kang | A42B 1/004 2/12 |
| 6,401,258 | B1 * | 6/2002 | Wilson | A42B 1/02 2/410 |
| D473,265 | S | 4/2003 | Miska | |

(Continued)

OTHER PUBLICATIONS

Make a Mask(r). Make a Mask and decorate! [online], [retrieved on Nov. 14, 2014]. Retrieved from the Internet <URL:http://www.makeamask.com/pages/hints-tips>.

(Continued)

*Primary Examiner* — Nathan Durham
*Assistant Examiner* — Abby Spatz
(74) *Attorney, Agent, or Firm* — Woodard, Emhardt, Moriarty, McNett & Henry LLP

(57) ABSTRACT

A decorative headgear simulating the appearance of a racing helmet is disclosed. It is in the form of a sheet of thin flexible material. The sheet is shaped and configured with a back panel (BP), a right panel (RP), a left panel (LP), a top panel (TP), a front panel (FP), and a chin cover (CC), all of which are adapted for inter-connection to form the helmet.

35 Claims, 19 Drawing Sheets

(56) References Cited

U.S. PATENT DOCUMENTS

| | | | | | |
|---|---|---|---|---|---|
| 6,941,582 | B2 | | 9/2005 | Miska | |
| 7,536,731 | B1 | | 5/2009 | Feldman | |
| D651,355 | S | | 12/2011 | Schwabe et al. | |
| D693,994 | S | | 11/2013 | Brown | |
| D699,020 | S | * | 2/2014 | Caird | D2/878 |
| D735,448 | S | * | 8/2015 | Caird | D2/870 |
| D743,674 | S | | 11/2015 | Caird | |
| D748,378 | S | * | 2/2016 | Caird | D2/870 |
| 2005/0050617 | A1 | | 3/2005 | Moore, III et al. | |
| 2014/0150164 | A1 | * | 6/2014 | Lucier | A41G 7/00 2/173 |

OTHER PUBLICATIONS

Make a Mask(r). NFL helmet style masks [online], [retrieved on Nov. 14, 2014]. Retrieved from the Internet <URL:http://www.makeamask.com/pages/nfl-helmet-style-masks>.
Photograph of other's rally helmet taken Jul. 2014.

* cited by examiner

DECORATIVE HELMET

CROSS-REFERENCE TO RELATED APPLICATIONS

The present application is a continuation-in-part of U.S. patent application Ser. No. 14/551,593 filed Nov. 24, 2014, and U.S. patent application Ser. No. 29/510,001 filed Nov. 24, 2014, both of which are entitled "Decorative Football Helmet" and both of which are hereby incorporated by reference to the extent not inconsistent.

BACKGROUND

This invention relates to decorative headgear, and more specifically to decorative headgear simulating the appearance of an American-football helmet.

American football is immensely popular, being played by the NFL, many colleges, high schools and otherwise. Many fans enjoy showing their support for their team by wearing jerseys and other indicators of affiliation. While perhaps the most iconic piece of equipment for American-football is its helmet; but, such helmets are expensive, heavy, and cumbersome, and accordingly have limitations on fan use and/or distribution to fans.

Various foldable headgear has existed. A mask like a football helmet offered by MakeAMask includes two metal fasteners to hold together a series of strips radiating from such fasteners to the rear and back half of the head. Headgear shown in U.S. Pat. No. 6,941,582 B2 has a novelty head covering with mirror image sides of a football helmet joined along a fold line at the front and over an integral facemask. Thus, there is a need for improvement in this field.

The present invention provides a decorative headgear that simulates the appearance of an American-football helmet while doing so in a manner that is amenable to low costs, compact packing and shipping volume, and easy assembly.

SUMMARY

The claims, and only the claims, recite the invention. In summary, it may comprise a decorative headgear simulating the appearance of an American-football helmet. It is made from one or more sheets of thin flexible material. The sheets are shaped and configured with a back panel, a right panel, a left panel, a top panel, a front panel, and a facemask, all of which are adapted for inter-connection to form the helmet. The side panels may comprise sub-panels, and their edges may converge bottom to top. Those may be connected to the top panel by connectors. Football team indicia may be on the sides of the helmet.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
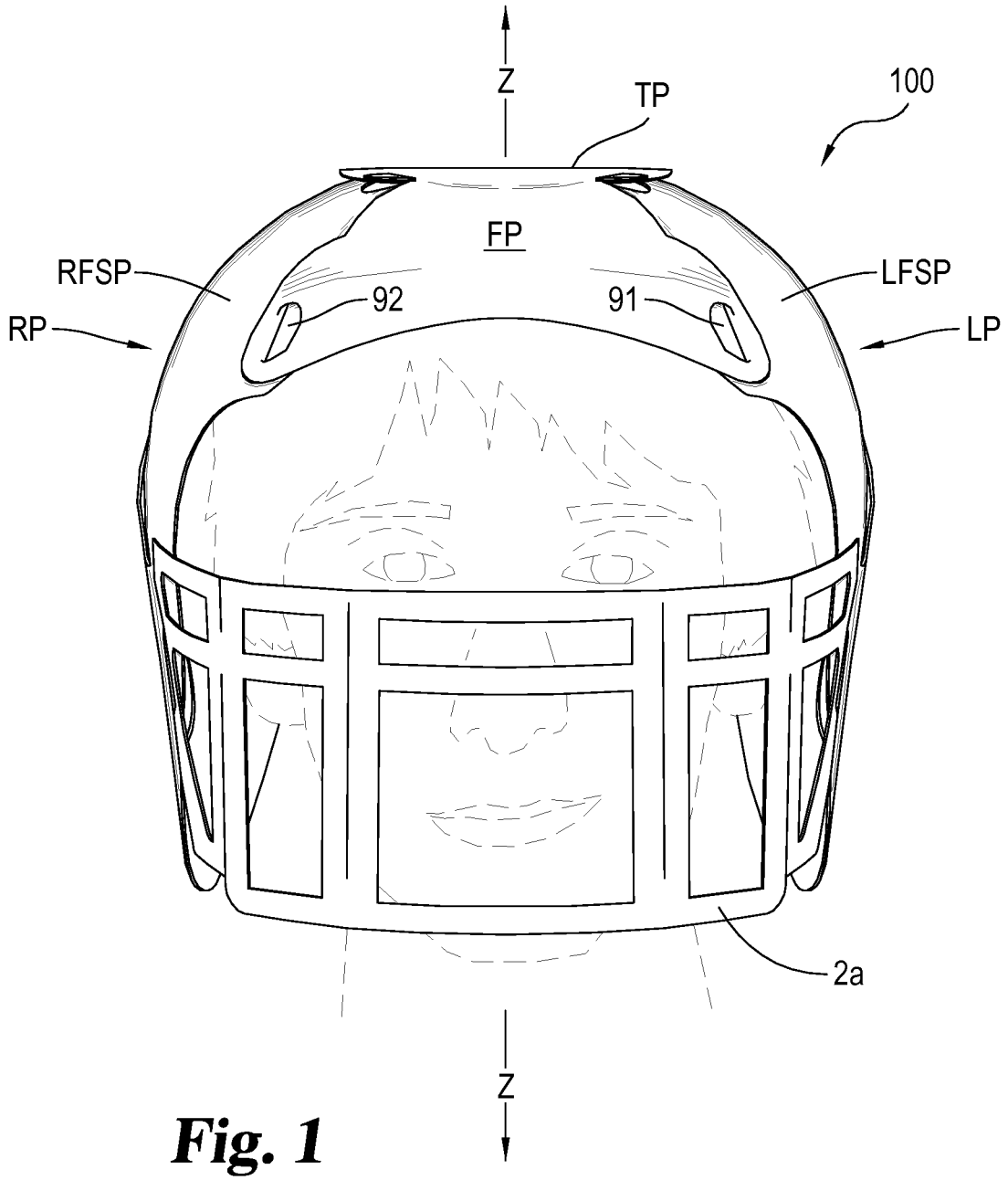
FIG. 1 is a front elevation view of one example of the present invention assembled in three dimensions to form a decorative headgear simulating and American-football helmet.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 8:
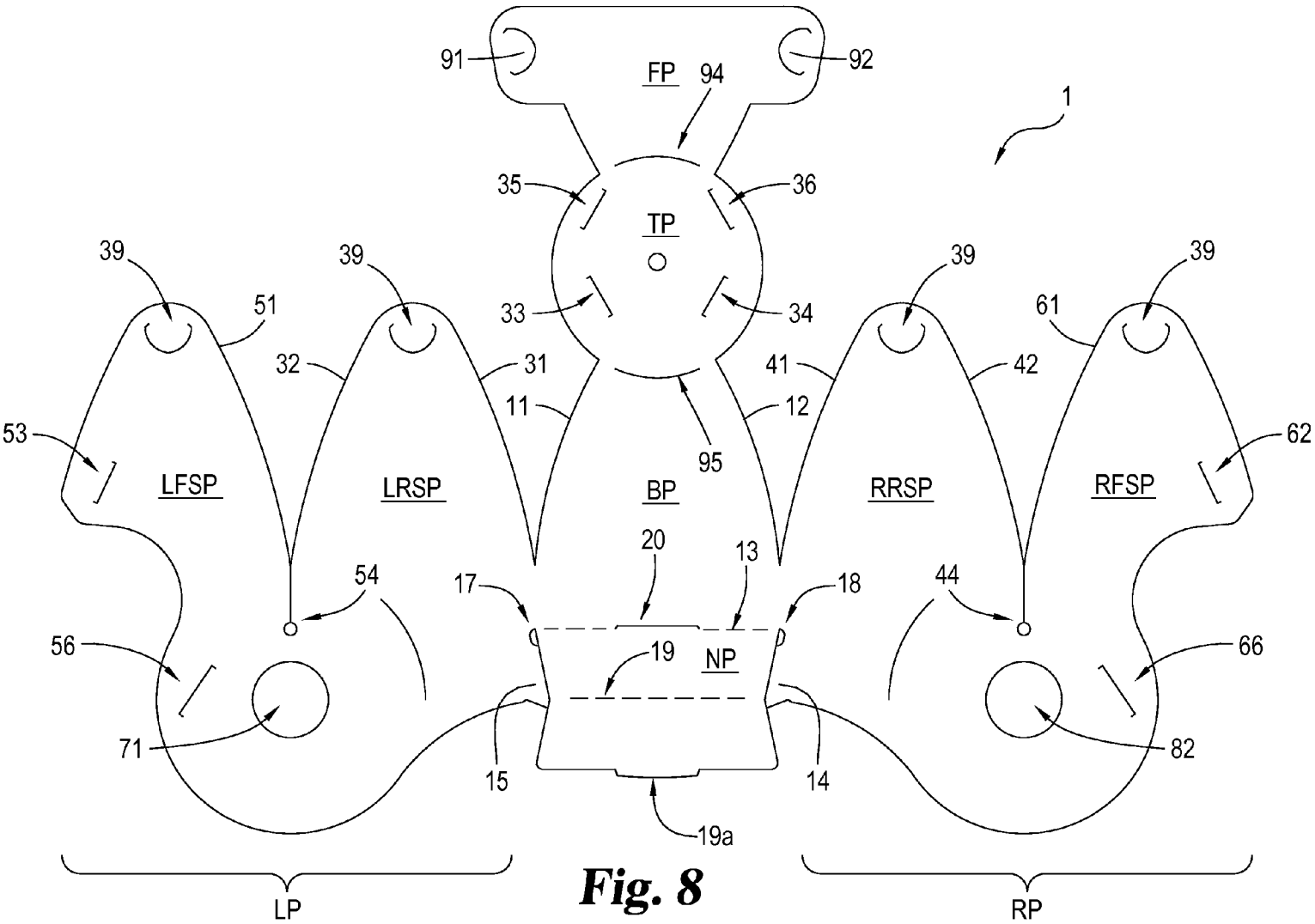
FIG. 8 is a top plan view of a helmet sheet in two dimensions for making the example of FIG. 1.

With reference to the drawing Figures, for example FIGS. 1-7, decorative headgear 100 is shown simulating the appearance of an American-football helmet. FIG. 8 shows an example of a sheet 1 used to make headgear 100. FIGS. 1-7 also form an ornamental design, depicted on a wearer shown in phantom lines. The headgear is made from one or more sheets, such as a helmet sheet with face mask or a helmet sheet 1 with a separate facemask sheet 2*a*, 2*b* (shown in FIGS. 9A and 9B, respectively). They are shown in two dimensions in FIGS. 8. 9A and 9B, and assembled in three dimensions in FIGS. 1-7 and 10. Other shapes, sizes (e.g. adult, youth; small, medium, large, etc.) and proportions consistent with this written description are also contemplated.

For example with the helmet sheet 1 of thin flexible material, the helmet sheet is shaped to comprise several panels. These may include subpanels, such as two or three subpanels making up each of the left and right panels.

As the illustrated example shows in FIG. 8, the helmet sheet may include a back panel (BP), the BP partially defined by a BP-right generally vertical edge 12 and a BP-left vertical edge 11, wherein in two-dimensions the two BP vertical edges converge towards each other bottom to top. It may also have a right panel (RP), wherein the RP in two-dimensions comprises a right rear sub-panel (RRSP), the RRSP integral with the BP below the BP-right generally vertical edge 12, the RRSP partially defined by a RRSP-leading generally vertical edge 42 and a RRSP-trailing generally vertical edge 41, wherein the two RRSP vertical edges converge towards each other bottom to top; and a right front sub-panel (RFSP), the RFSP integral with the RRSP below the RRSP-leading generally vertical edge 42, the RFSP partially defined by a RFSP-trailing vertical edge 61, wherein the RFSP trailing generally vertical 61 edge diverges away from the RRSP-leading generally vertical edge 42 bottom to top.

Likewise, on the other side sheet 1 may include a left panel (LP), wherein the LP in two-dimensions comprises: a left rear sub-panel (LRSP), the LRSP integral with the BP below the BP-left generally vertical edge 11, the LRSP partially defined by a LRSP-leading generally vertical edge 32 and a LRSP-trailing generally vertical edge 31, wherein the two LRSP vertical edges converge towards each other bottom to top; and, a left front sub-panel (LFSP), the LFSP integral with the LRSP below the LRSP-leading generally vertical edge 32, the LFSP partially defined by a LFSP-trailing generally vertical edge 51, wherein the LFSP trailing vertical edge 51 diverges away from the LRSP-leading generally vertical edge 32 bottom to top. Optionally, but preferably the left panel and right panel are symmetric.

Sheet 1 preferably has a top panel (TP), and a front panel (FP), the FP located above a wearer's eyes. Preferably, the FP integral with only one of the group consisting of: TP, RFSP and LFSP.

Figure 9A:
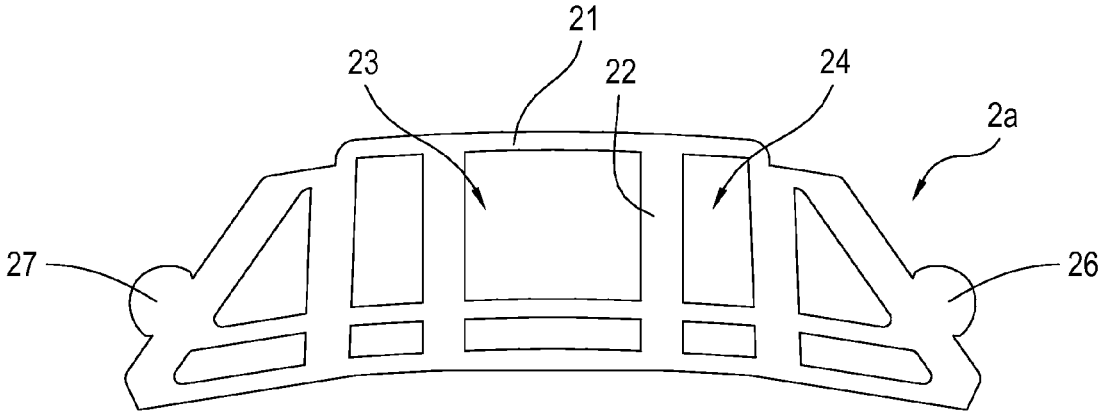
FIG. 9A is a top plan view of a facemask sheet in two dimensions for making the example of FIG. 1.
Figure 9B:
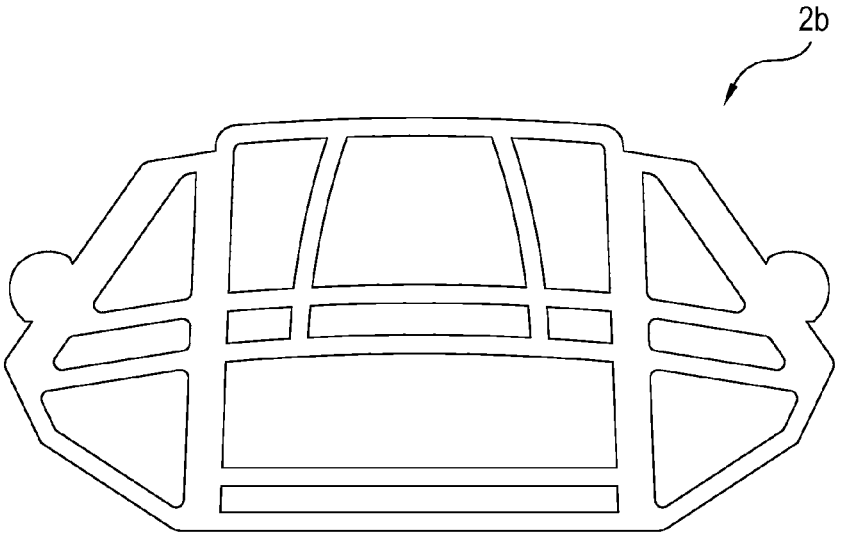
FIG. 9B is an alternative of the facemask of FIG. 9A.
Figure 10:
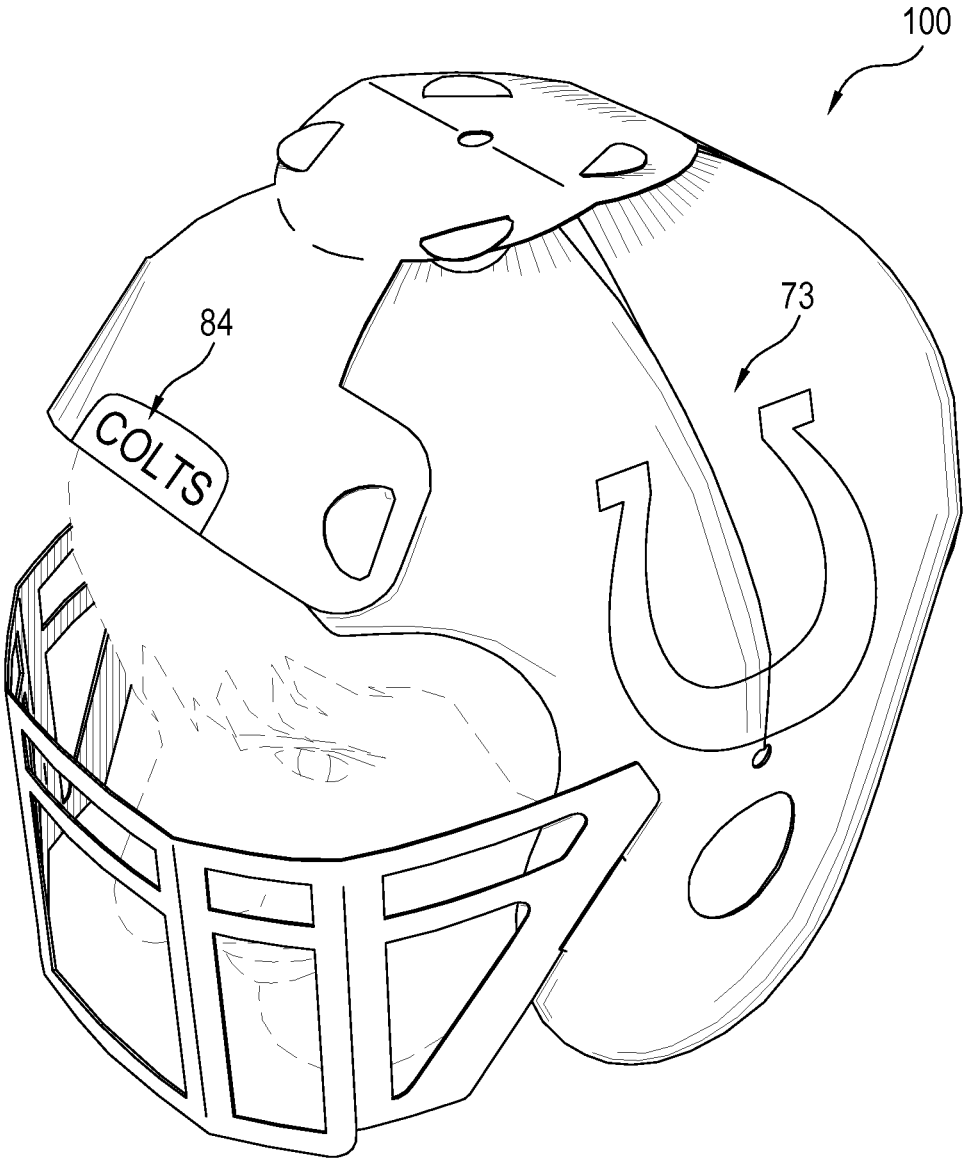
FIG. 10 is a top-front perspective view of the example of FIG. 7 with indicia added.

One or more facemask(s) 2*a* and/or 2*b* (for example) (FM) simulating an American-football helmet facemask with bars, such as bars 21, 22 and gaps, such as gaps 23, 24 between the bars are provide (see e.g. FIG. 9A). The facemask may be separate from or integral with helmet sheet 1. Optionally, but preferably, FM is a sheet of thin flexible material separate from the helmet sheet, and wherein the FM has at left and/or right sides thereof one or more slit/tab interface 27, 26 adapted for connection respectively with a slit/tab interface 66 on the RFSP and with a slit/tab interface 56 on the LFSP.

The helmet sheet 1 is at least on an exterior surface thereon made primarily of thin sheet plastic. Likewise, the sheet(s) making up the facemask may be of similar material. This may include plastic sheet(s), or a laminate with a plastic sheet layer on the outside (or both sides) and some other material(s) (e.g. cardboard, paper, photopaper, foil and/or otherwise) on the opposite side or in the interior. Such materials optionally may be in lieu of such plastic. With a plastic outer layer, it may be generally clear with printed colors and printed indicia on a layer under such clear plastic or on an inner surface of the plastic. Or the plastic may colored, opaque or otherwise, with or without printing thereon.

The headgear 100 optionally, but preferably has the BP-right generally vertical edge 12 and the RRSP-trailing generally vertical edge 41 each curvilinear, such that when the headgear is assembled in three-dimensions has an edge variance 200 (see e.g. FIG. 4) not exceeding 10 millimeters; and, on the other side the BP-left generally vertical edge 11 and the LRSP-trailing generally vertical edge 31 are each curvilinear, and again when the headgear is assembled in three-dimensions has an edge variance 201 (see e.g. FIG. 4) not exceeding 10 millimeters.

Also, optionally, but preferably, as between the subpanels of the right and left panels, the RRSP-leading generally vertical edge 42 and the RFSP-trailing generally vertical edge 61 are each curvilinear, and when the headgear is assembled in three-dimensions has an edge variance 202 (see e.g. FIG. 2) not exceeding 10 millimeters; and, the LRSP-leading generally vertical edge 32 and the LFSP-trailing generally vertical edge 51 are each curvilinear, and when the headgear is assembled in three-dimensions has an edge variance 203 (see e.g. FIG. 3) not exceeding 10 millimeters.

While the forgoing edge variances are, preferably not to exceed 10 millimeters, even more preferably they do not exceed 5 millimeters. Alternatively, while their edge variance may exceed 5 or 10 millimeters, the average edge variance (average along a given set of opposing free edges) does not exceed 10 millimeters, or more preferably an average edge variance of 5 mm or less.

Such optional curved edges, may optionally be segments of generally sinusoidal curves and/or second order curves, and may geometrically simulate homolosine curving to form portions of the headgear in a spherical or somewhat spherical shape in three dimensions.

Optionally, but preferably, the top panel TP integral with only one of the group consisting of: BP, RRSP, RFSP, LRSP and LFSP. Most preferably, it is integral with, and only with, the back panel BP.

Optionally, but preferably, the headgear in three dimensions it is assembled without any metal connectors. And, optionally, but preferably, there are the top panel TP has four slit/tab interfaces 33, 34, 35, 36 respectively adapted for connection with slit/tab interfaces 39 at upper portions of a remaining four of the group consisting of: BP, RRSP, RFSP, LRSP and LFSP with which the TP is not integral. For example, if the top panel is integral with the back panel, then it is not intergral with the RRSP, RFSP, LRSP or LFSP. Optionally, but preferably, the top panel TP is generally circular, and optionally, but preferably, the TP is integral with the back panel BP.

Optionally, but preferably, fold lines, such as beside slits, such as curve slits at the front 94 and back 95 of top panel TP (see e.g. FIGS. 6 and 8) may facilitate bending or curving between the top panel and the front and back panels, respectively. Optional slit 20 (see e.g. FIGS. 4 and 8) may do that as between the back panel BP and neck panel NP.

Optionally, but preferably, front panel FP may have connectors, such as slit/tab interfaces 91, 92 to connect with connectors, such as slit/tab interfaces 53, 62 on the respective front sub-panels (see e.g. FIGS. 1 and 8).

Optionally, but preferably, the RP includes an ear hole 82 therein, and the LP includes an ear hole 71 therein. Optionally, but preferably, the printed indicia 84, 73 comprising a football team logo, the printed indicia on at least the RP, LP or both. This may be, for example, any NFL, college or other logo. Here, in FIG. 10, as merely one example, the NFL's Indianapolis Colts logo is shown.

The headgear is such that optionally, but preferably, the BP has a neck panel (NP), the NP integral with the BP along a bottom of the BP, the NP partially defined by a folding line 13 between the BP and the NP, wherein the NP is adapted to be folded inwardly along fold line 19 (see e.g. FIGS. 4 and 8) and between the BP and a wearer's neck. Fold line 13 may be on either side of slit 20, which may receive tab 19*a*. Optionally, the device may further comprise a left integral tab (LIT) 15 integral with the LRSP and a right integral tab (RIT) 14 integral with the RRSP, the LIT and the RIT each adapted to extend inwardly and between the BP and the NP after fold along 19 is made.

Optionally but preferably, the RRSP-leading generally vertical edge and a RFSP-trailing vertical edge converge at generally round right side anti-stress riser hole 44; and, (2) the LRSP-leading generally vertical edge and a LFSP-trailing vertical edge converge at generally round left side anti-stress riser hole 54. This may reduce stress concentrations and an associated tear propagating through the sheet. Other such anti-stress riser holes or indents may be used, such as the anti-stress riser indents 17, 18 at either side of the neck panel.

Wherever here a connection is described as a slit/tab interface, either part may be inverted (e.g. slit interchanged for tab, and vice versa); and, on or more such slit-tab interface may be substituted with a connector as defined herein.

Figure 2:
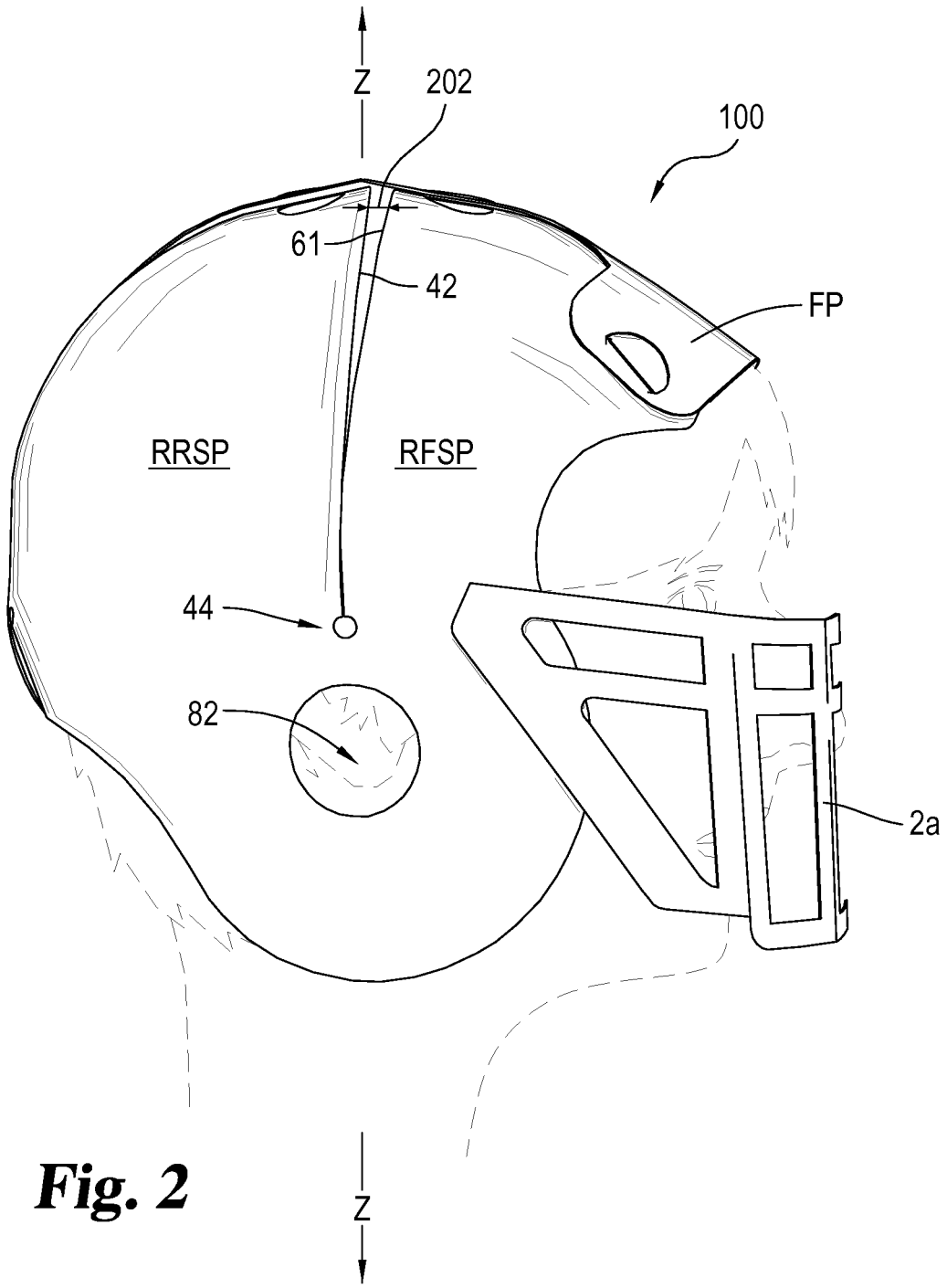
FIG. 2 is a right side elevation view of the example of FIG. 1.
Figure 3:
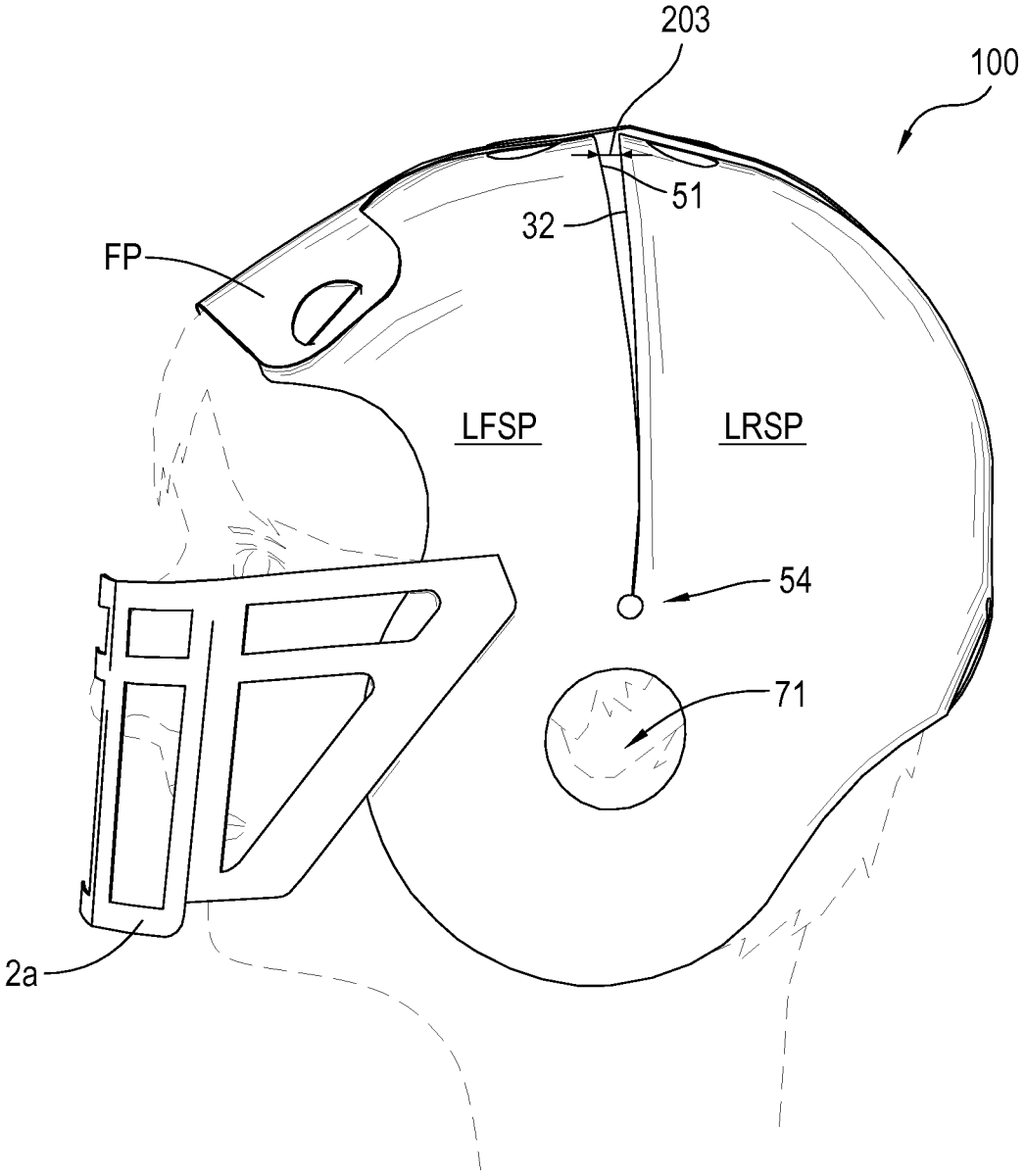
FIG. 3 is a left side elevation view of the example of FIG. 1.
Figure 4:
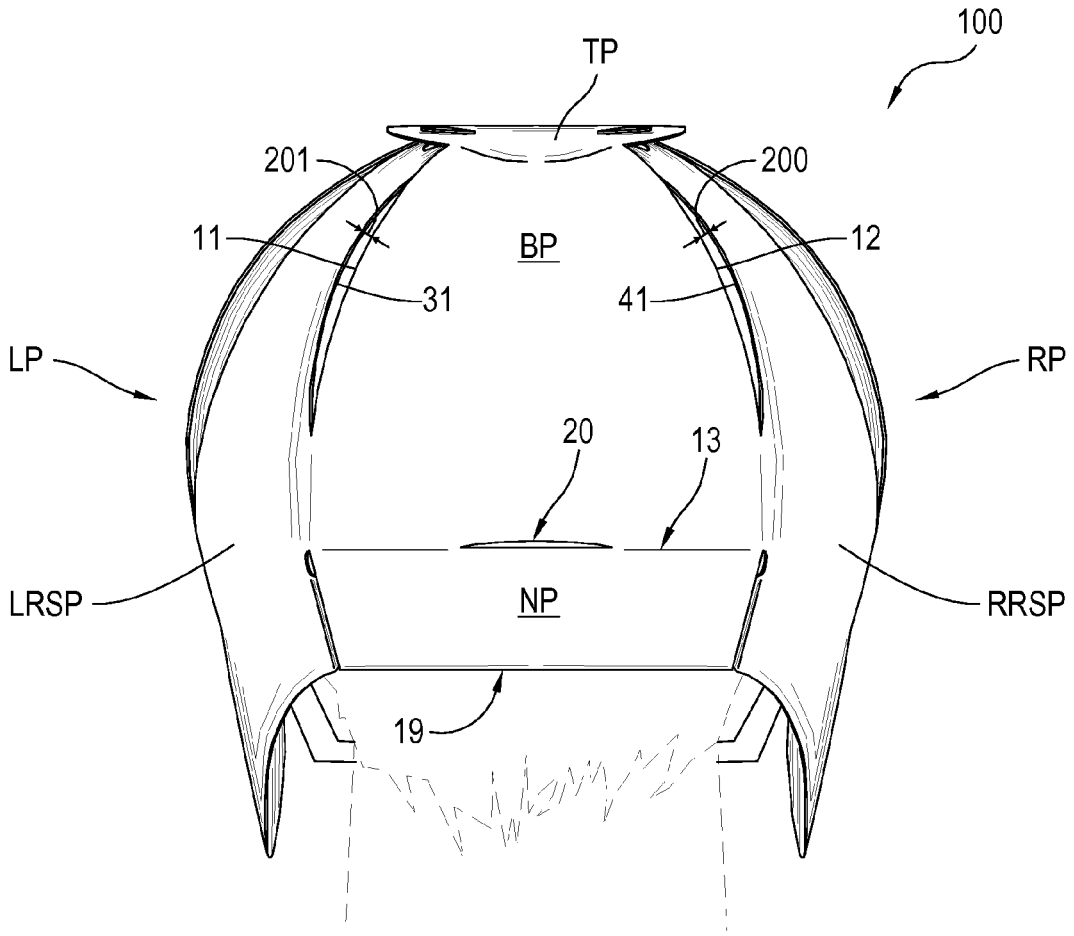
FIG. 4 is a rear elevation view of the example of FIG. 1.
Figure 5:
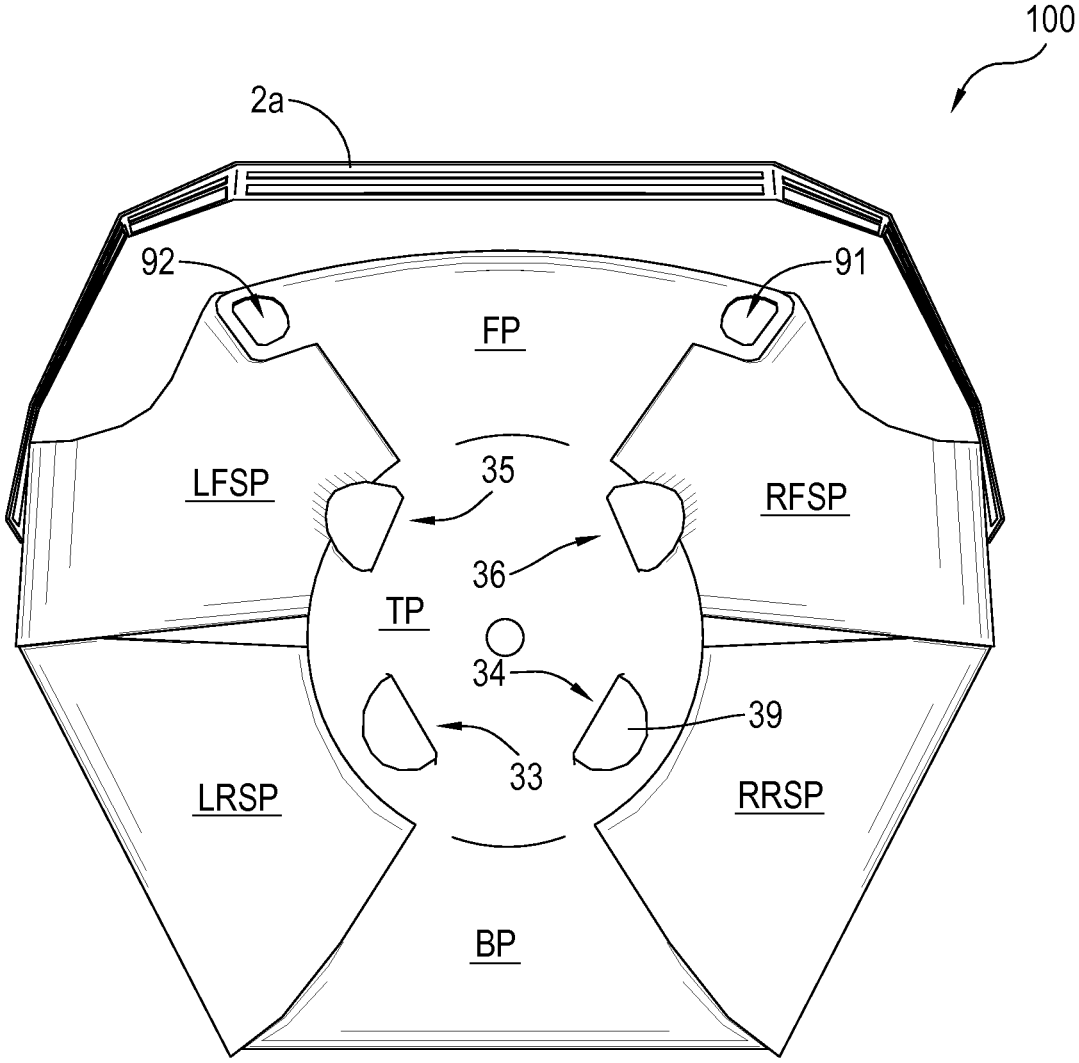
FIG. 5 is a top plan view of the example of FIG. 1.
Figure 6:
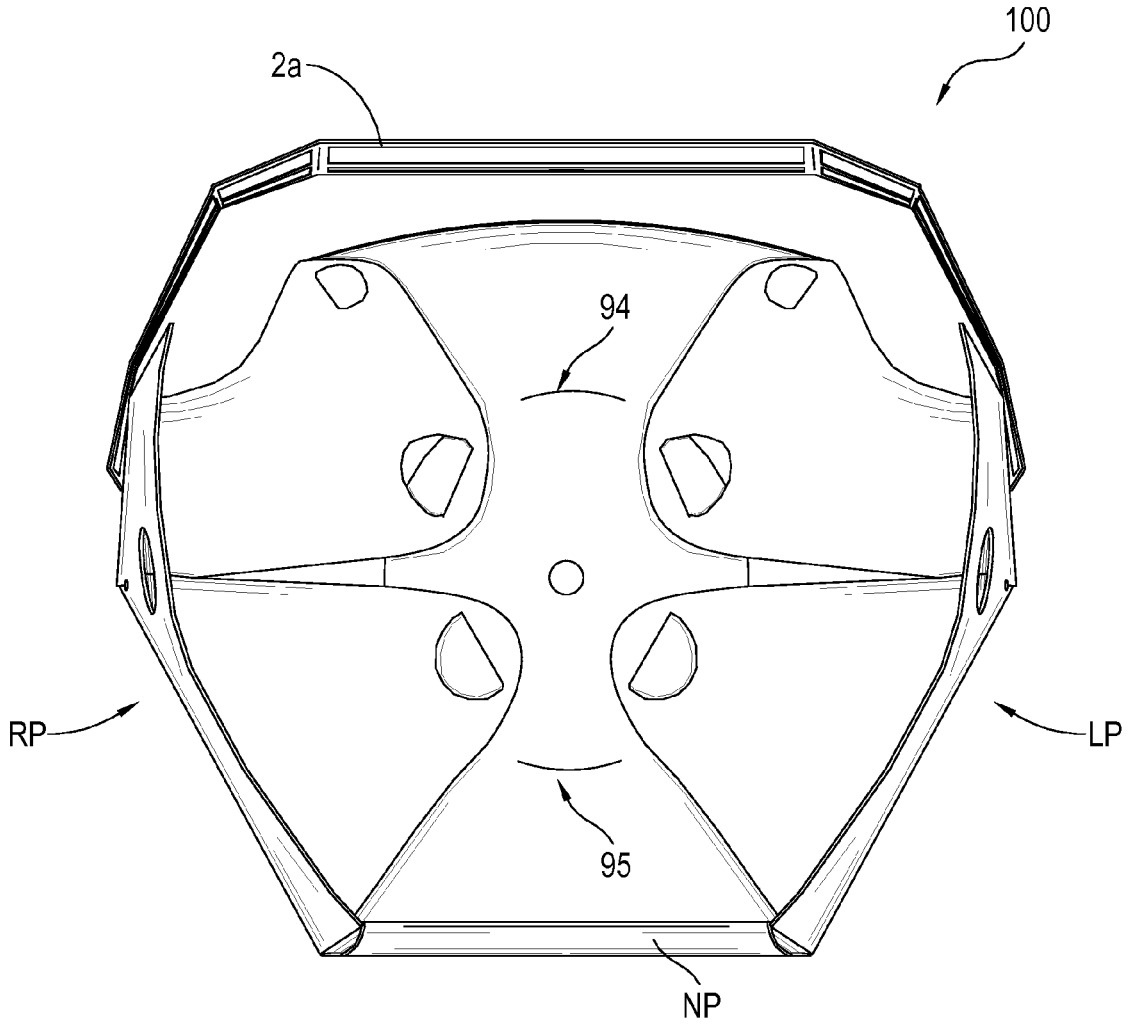
FIG. 6 is a bottom plan view of the example of FIG. 1.
Figure 7:
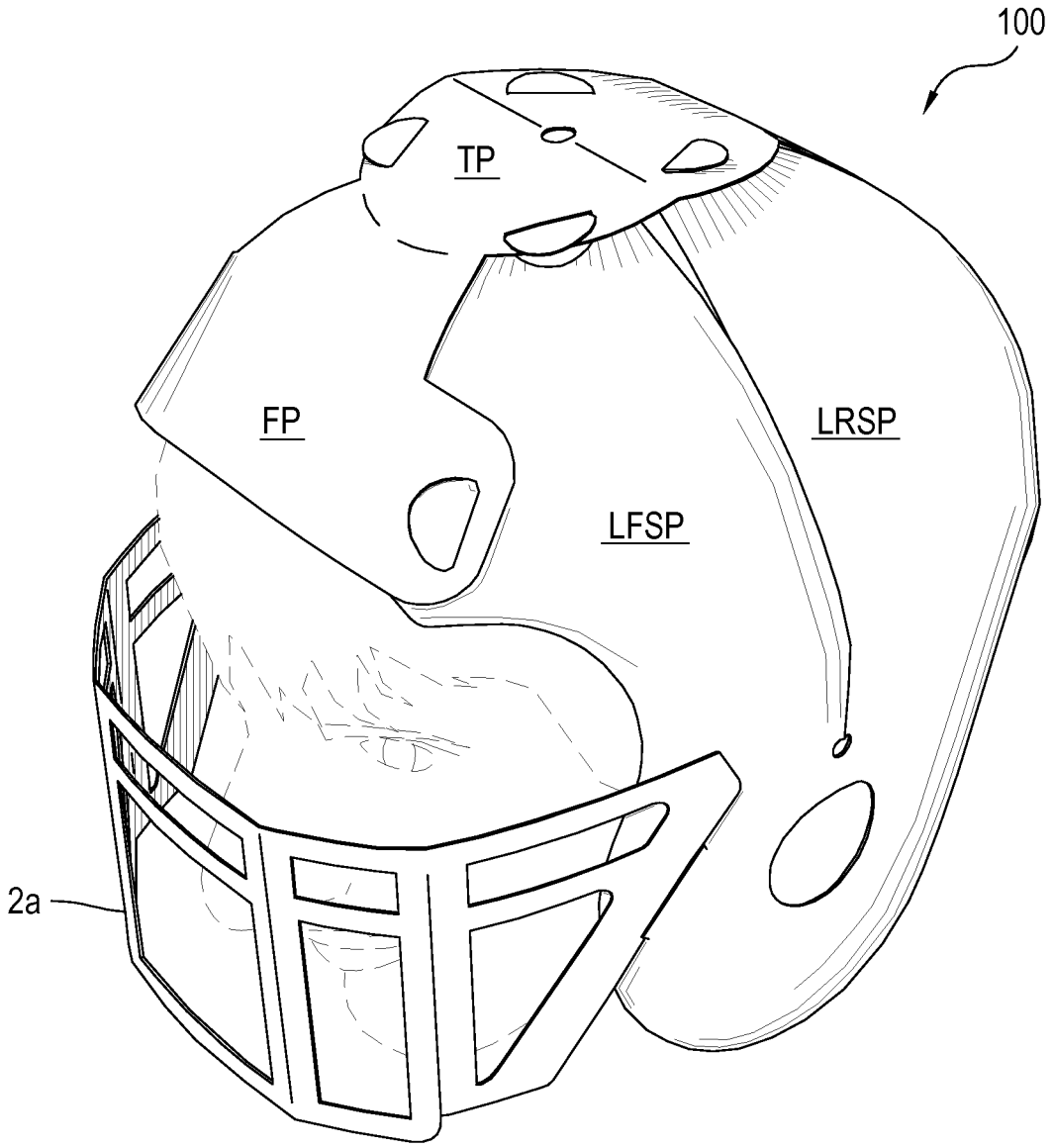
FIG. 7 is a top-front perspective view of the example of FIG. 1.

As can be now understood, the headgear may be assembled simply by starting from the back (back panel BP) and wrapping the right and left panels, including their subpanels generally in a vertical cylinder about axis Z (see FIGS. 1 and 2). This is done while wrapping the top and front panels, rearward to front, over the top of the space to be occupied by the wearer's head or skull. Thereafter, the upper portions of the right and left panels are curved inwardly toward the top panel TP and connected thereto, preferably near a perimeter of the top panel. The front connections of FP at 91 and 92 optionally are made. The face mask is attached.

Figure 18:
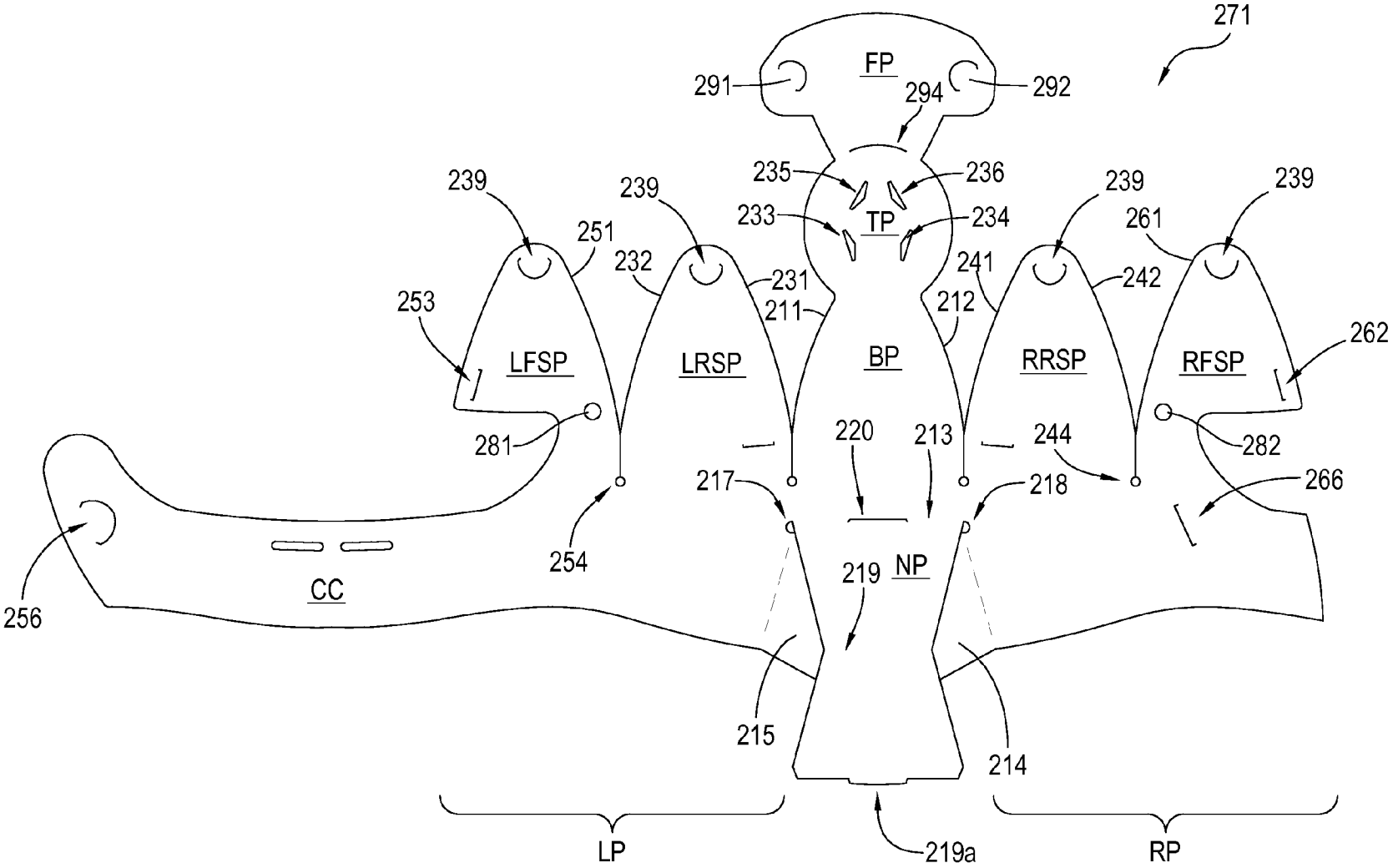
FIG. 18 is a top plan view of a helmet sheet in two dimensions for making the example of FIG. 11.

In an alternative embodiment, a decorative headgear 270 is shown simulating the appearance of a racing helmet. FIG. 18 shows an example of a sheet 271 used to make headgear 270. FIGS. 11-17 also form an ornamental design, depicted on a wearer shown in phantom lines. Headgear 270 has a similar structure as headgear 100. Corresponding features shown in headgear 100 and headgear 270 are given similar reference numerals; however the features in headgear 270 have a 2 in front. For example, a feature in headgear 270 that corresponds with feature 20 of headgear 100 is given the reference numeral 220.

As shown in FIG. 18, headgear 270 may include a back panel (BP), the BP partially defined by a BP-right generally vertical edge 212 and a BP-left vertical edge 211, wherein in two-dimensions the two BP vertical edges converge towards each other bottom to top. It may also have a right panel (RP), wherein the RP in two-dimensions comprises a right rear sub-panel (RRSP), the RRSP integral with the BP below the BP-right generally vertical edge 212, the RRSP partially defined by a RRSP-leading generally vertical edge 242 and a RRSP-trailing generally vertical edge 241, wherein the two RRSP vertical edges converge towards each other bottom to top; and a right front sub-panel (RFSP), the RFSP integral with the RRSP below the RRSP-leading generally vertical edge 242, the RFSP partially defined by a RFSP-trailing vertical edge 261, wherein the RFSP trailing generally vertical 261 edge diverges away from the RRSP-leading generally vertical edge 242 bottom to top.

Likewise, on the other side, sheet 271 may include a left panel (LP), wherein the LP in two-dimensions comprises: a left rear sub-panel (LRSP), the LRSP integral with the BP below the BP-left generally vertical edge 211, the LRSP partially defined by a LRSP-leading generally vertical edge 232 and a LRSP-trailing generally vertical edge 231, wherein the two LRSP vertical edges converge towards each other bottom to top; and, a left front sub-panel (LFSP), the LFSP integral with the LRSP below the LRSP-leading generally vertical edge 232, the LFSP partially defined by a LFSP-trailing generally vertical edge 251, wherein the LFSP trailing vertical edge 251 diverges away from the LRSP-leading generally vertical edge 232 bottom to top. Optionally, but preferably the left panel and right panel are symmetric.

Sheet 271 preferably has a top panel (TP), and a front element comprising at least one of a visor (V) located in front of and above a wearer's eyes and/or a chin cover (CC) simulating racing helmet chin guard. The CC runs horizontally generally in front of a wearer's chin and defines a generally horizontal viewing opening for a wearer's eyes.

Optionally, but preferably, the front element comprises both the V and the CC. Also optionally, but preferably, the RFSP and the LFSP each have a cutout region partially defining lateral portions of a generally horizontal viewing opening for the wearer's eyes.

Optionally, but preferably, the V is a sheet of thin flexible material separate from the helmet sheet 271. The V has at left and right sides thereof a slit/tab interface adapted for connection respectively with a slit/tab interface 282 on the RFSP and with a slit/tab interface 281 on the LFSP. Optionally, but preferably, headgear 270 may have a transparent shield over the horizontal viewing opening.

Optionally, but preferably, the CC is a sheet of thin flexible material integral with one of the front side panels of the helmet sheet. The CC has a side slit/tab interface 256 adapted for connection respectively with a slit/tab interface 266 on an opposing front side panel.

The headgear 270 optionally, but preferably has the BP-right generally vertical edge 212 and the RRSP-trailing generally vertical edge 241 each curvilinear, such that when the headgear is assembled in three-dimensions it has an edge variance 300 (see e.g. FIG. 14) not exceeding 10 millimeters; and, on the other side the BP-left generally vertical edge 211 and the LRSP-trailing generally vertical edge 231 are each curvilinear, and again when the headgear is assembled in three-dimensions, it has an edge variance 301 (see e.g. FIG. 14) not exceeding 10 millimeters.

Also, optionally, but preferably, as between the subpanels of the right and left panels, the RRSP-leading generally vertical edge 242 and the RFSP-trailing generally vertical edge 261 are each curvilinear, and when the headgear is assembled in three-dimensions has an edge variance 302 (see e.g. FIG. 12) not exceeding 10 millimeters; and, the LRSP-leading generally vertical edge 232 and the LFSP-trailing generally vertical edge 251 are each curvilinear, and when the headgear is assembled in three-dimensions has an edge variance 303 (see e.g. FIG. 13) not exceeding 10 millimeters.

While the forgoing edge variances are, preferably not to exceed 10 millimeters, even more preferably they do not exceed 5 millimeters. Alternatively, while their edge variance may exceed 5 or 10 millimeters, the average edge variance (average along a given set of opposing free edges) does not exceed 10 millimeters, or more preferably an average edge variance of 5 mm or less.

Such optional curved edges, may optionally be segments of generally sinusoidal curves and/or second order curves, and may geometrically simulate homolosine curving to form portions of the headgear in a spherical or somewhat spherical shape in three dimensions.

Optionally, but preferably, the top panel TP integral with only one of the group consisting of: BP, RRSP, RFSP, LRSP and LFSP. Most preferably, it is integral with, and only with, the back panel BP.

Optionally, but preferably, the headgear in three dimensions is assembled without any metal connectors. And, optionally, but preferably, the top panel TP has four slit/tab interfaces 233, 234, 235, 236 respectively adapted for connection with slit/tab interfaces 239 at upper portions of a remaining four of the group consisting of: BP, RRSP, RFSP, LRSP and LFSP with which the TP is not integral. For example, if the top panel is integral with the back panel, then it is not intergral with the RRSP, RFSP, LRSP or LFSP. Optionally, but preferably, the top panel TP is generally circular, and optionally, but preferably, the TP is integral with the back panel BP.

The headgear is such that optionally, but preferably, the BP has a neck panel (NP), the NP integral with the BP along a bottom of the BP, the NP partially defined by a folding line 213 between the BP and the NP, wherein the NP is adapted to be folded inwardly along fold line 219 (see e.g. FIGS. 14 and 18) and between the BP and a wearer's neck. Fold line 213 may be on either side of slit 220, which may receive tab 219*a*. Optionally, the device may further comprise a left integral tab (LIT) 215 integral with the LRSP and a right integral tab (RIT) 214 integral with the RRSP, the LIT and the RIT each adapted to extend inwardly and between the BP and the NP after fold along 219 is made.

Optionally but preferably, the RRSP-leading generally vertical edge and a RFSP-trailing vertical edge converge at generally round right side anti-stress riser hole 244; and, the LRSP-leading generally vertical edge and a LFSP-trailing vertical edge converge at generally round left side anti-stress riser hole 254. This may reduce stress concentrations and an associated tear propagating through the sheet. Other such anti-stress riser holes or indents may be used, such as the anti-stress riser indents 217, 218 at either side of the neck panel.

Figure 11:
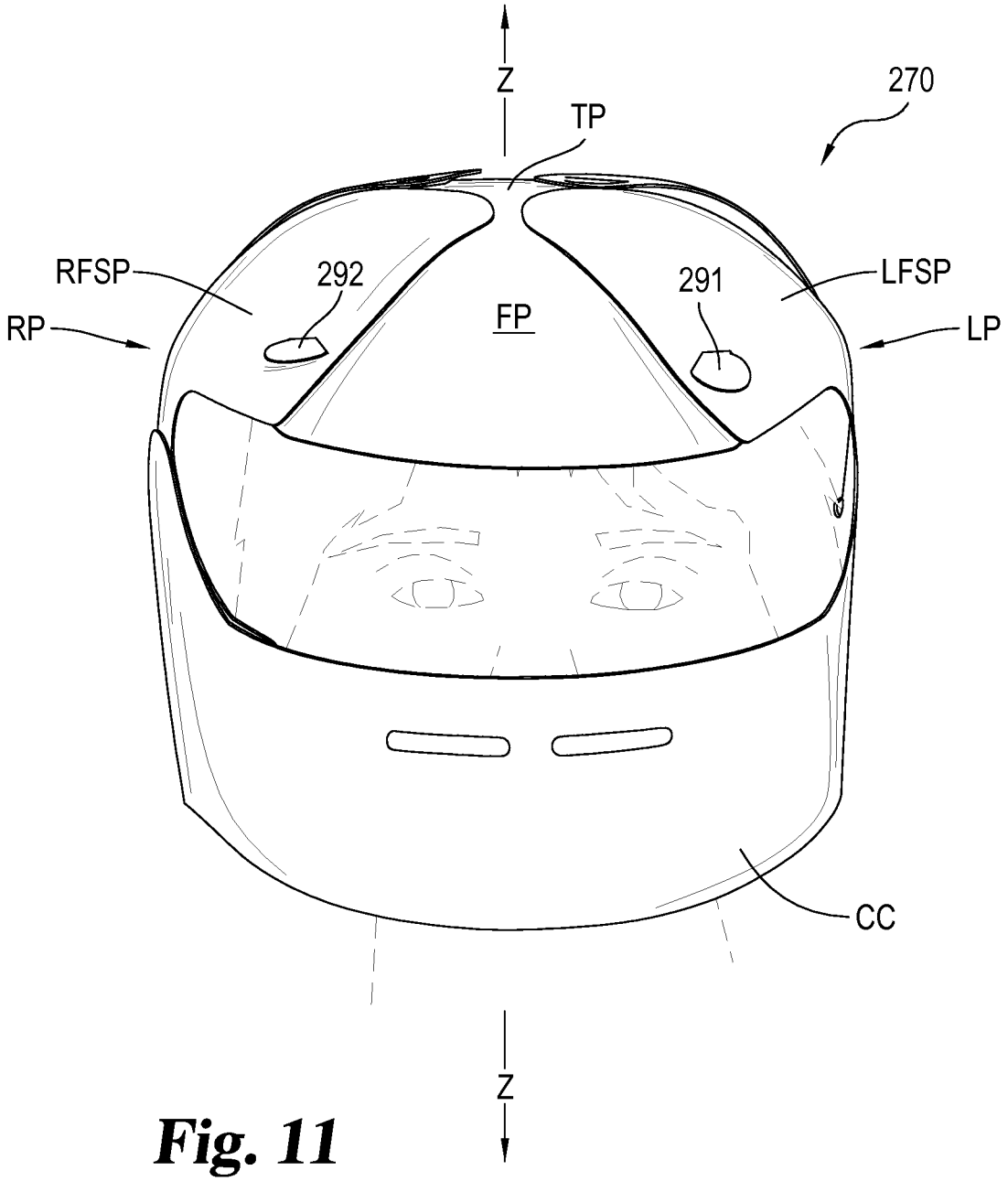
FIG. 11 is a front elevation view of one example of the present invention assembled in three dimensions to form a decorative headgear simulating an racing helmet.
Figure 12:
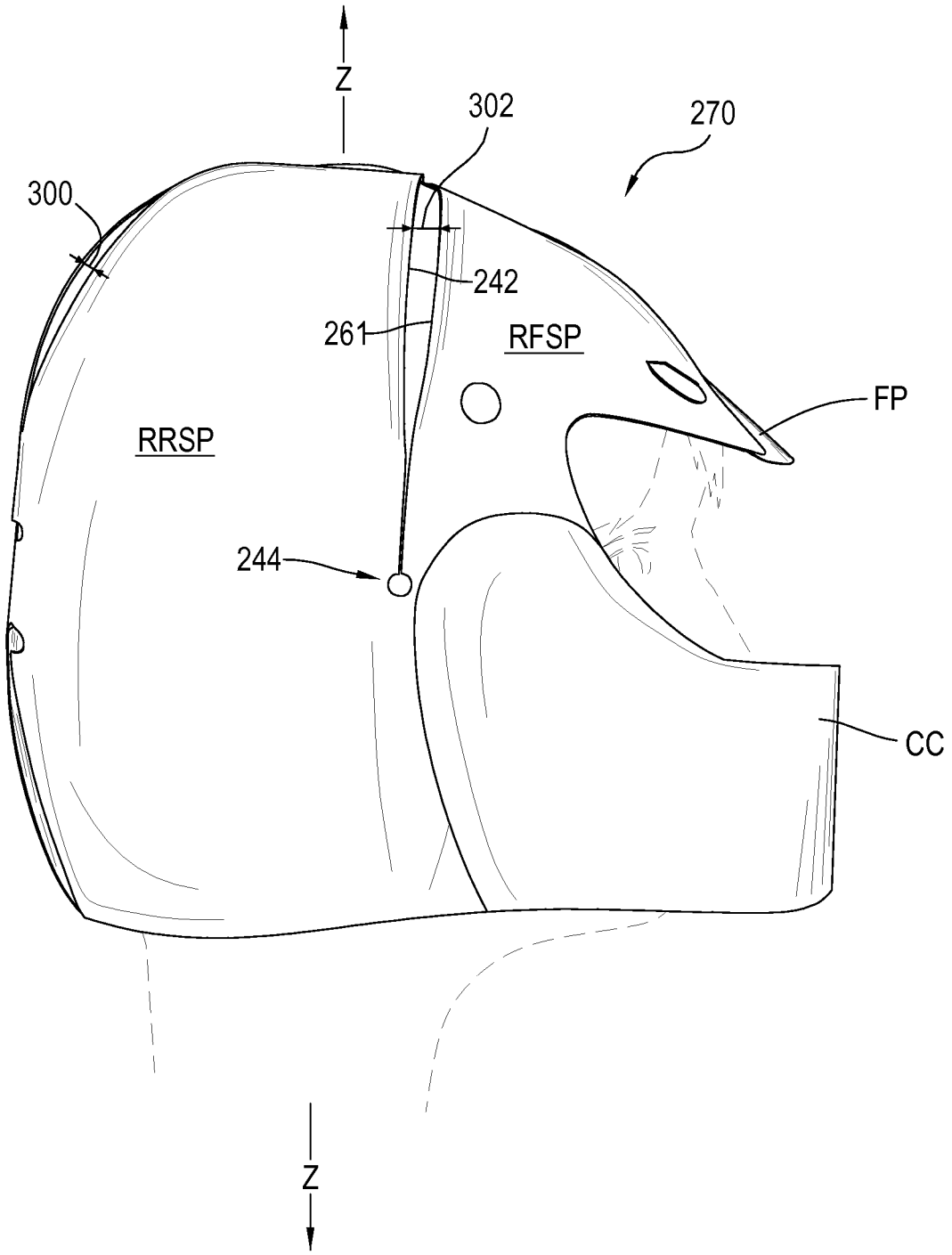
FIG. 12 is a right side elevation view of the example of FIG. 11.
Figure 13:
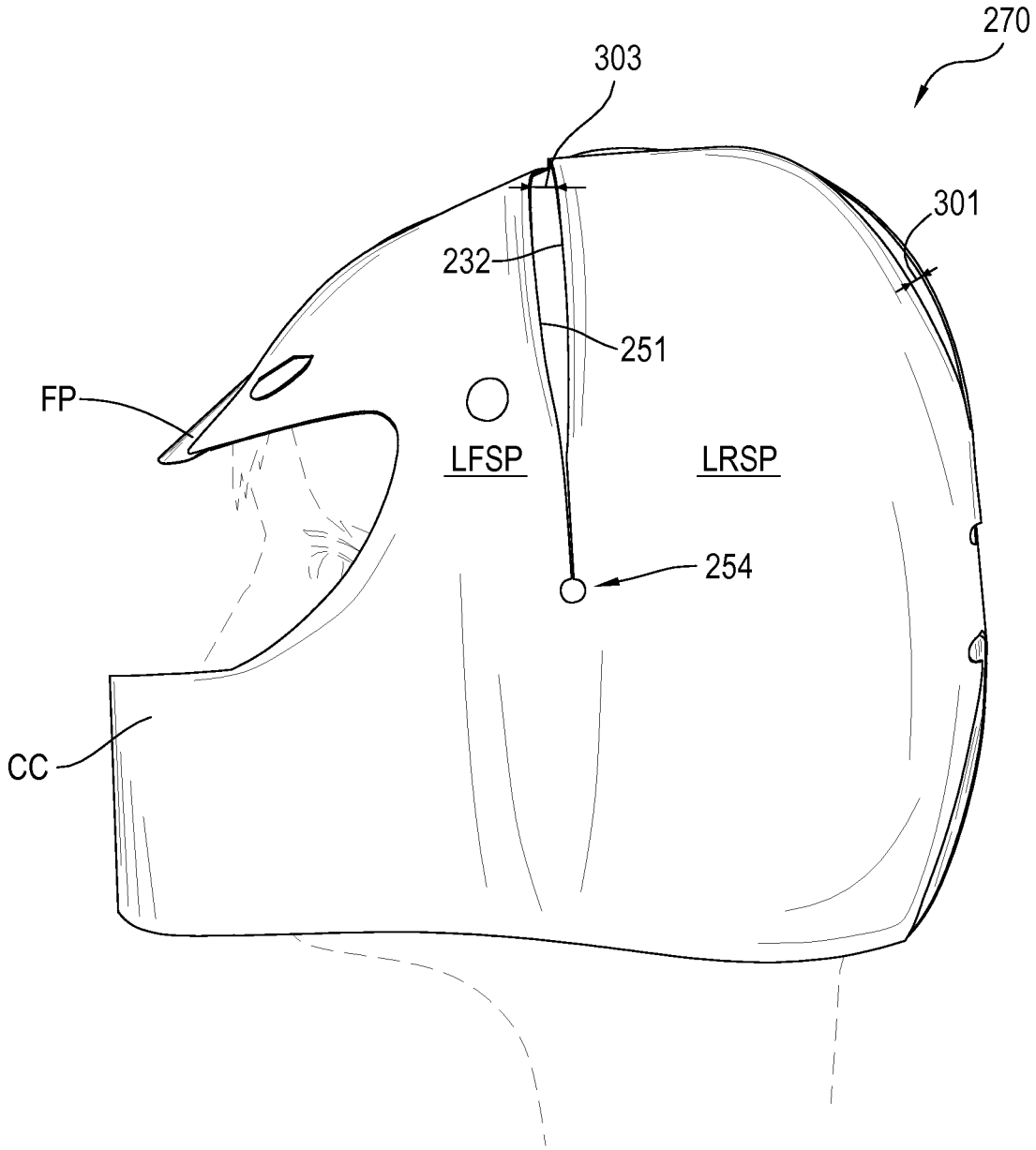
FIG. 13 is a left side elevation view of the example of FIG. 11.
Figure 14:
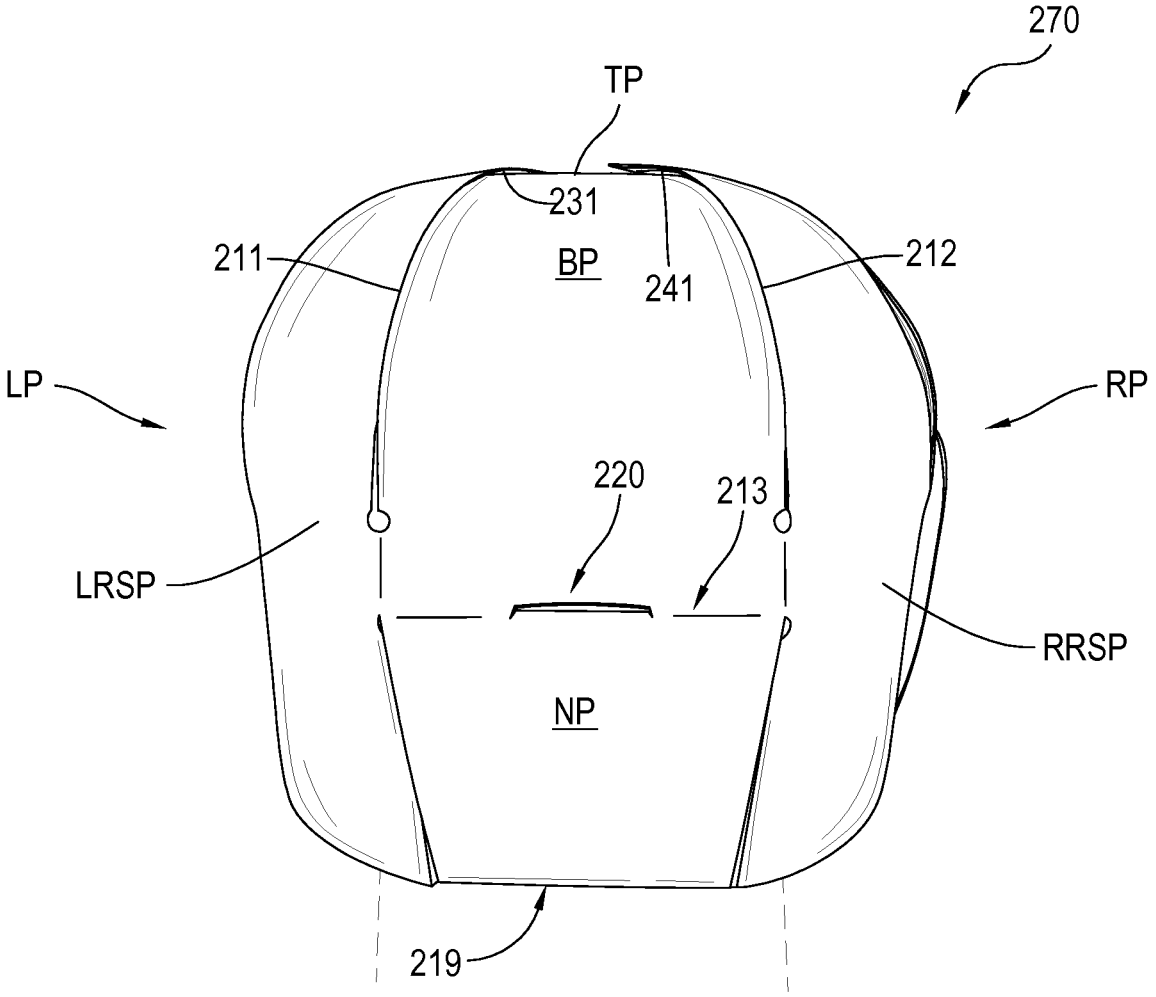
FIG. 14 is a rear elevation view of the example of FIG. 11.
Figure 15:
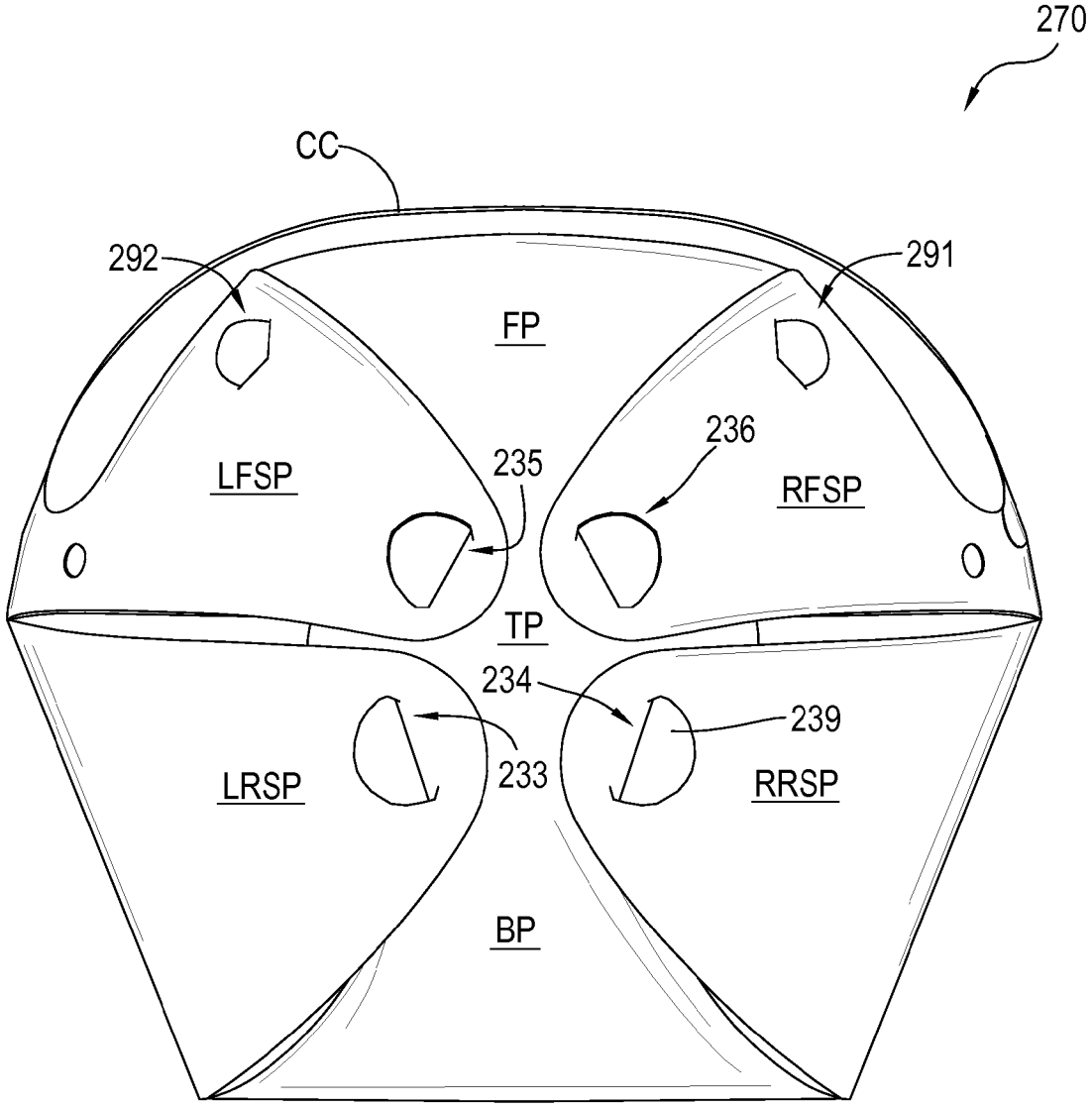
FIG. 15 is a top plan view of the example of FIG. 11.
Figure 16:
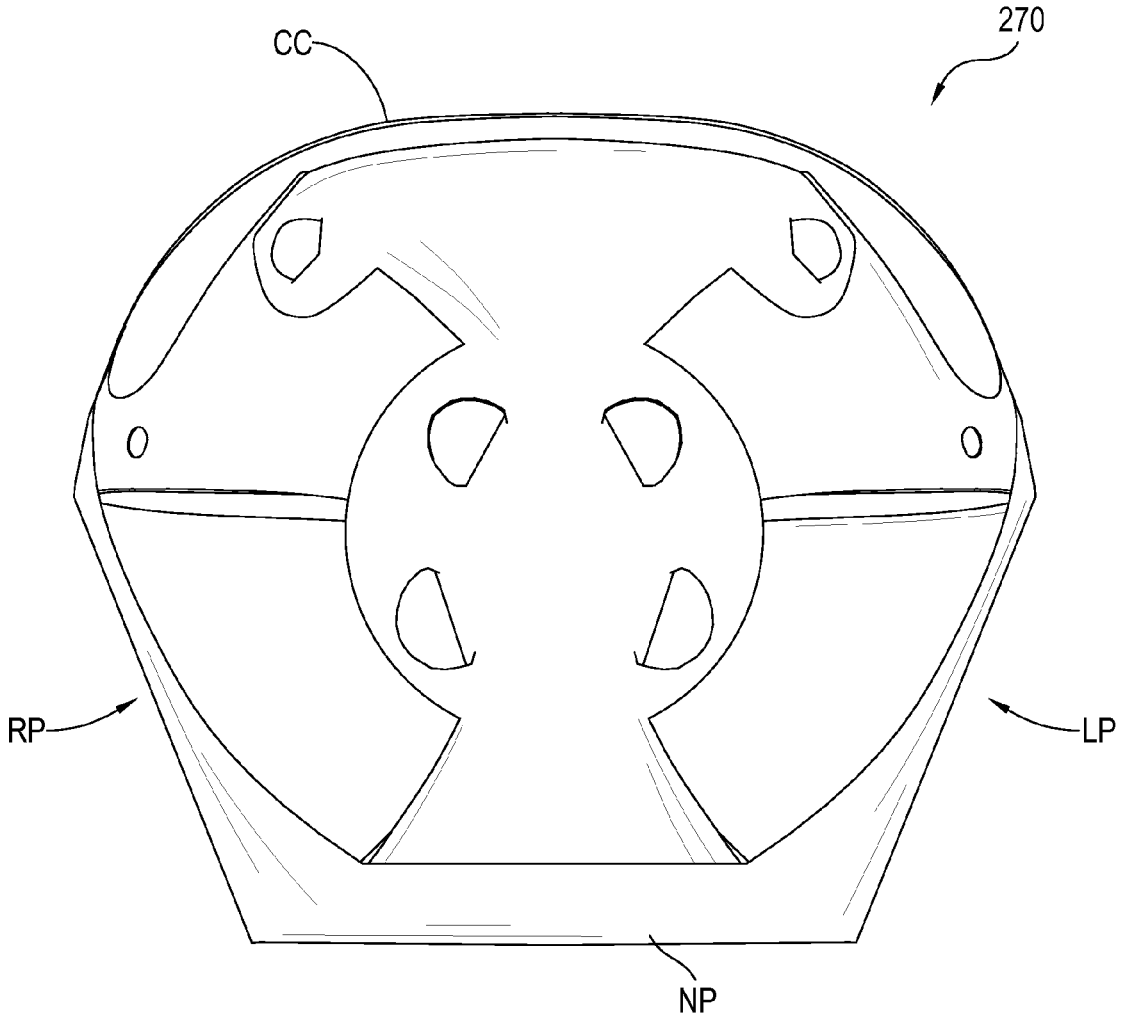
FIG. 16 is a bottom plan view of the example of FIG. 11.
Figure 17:
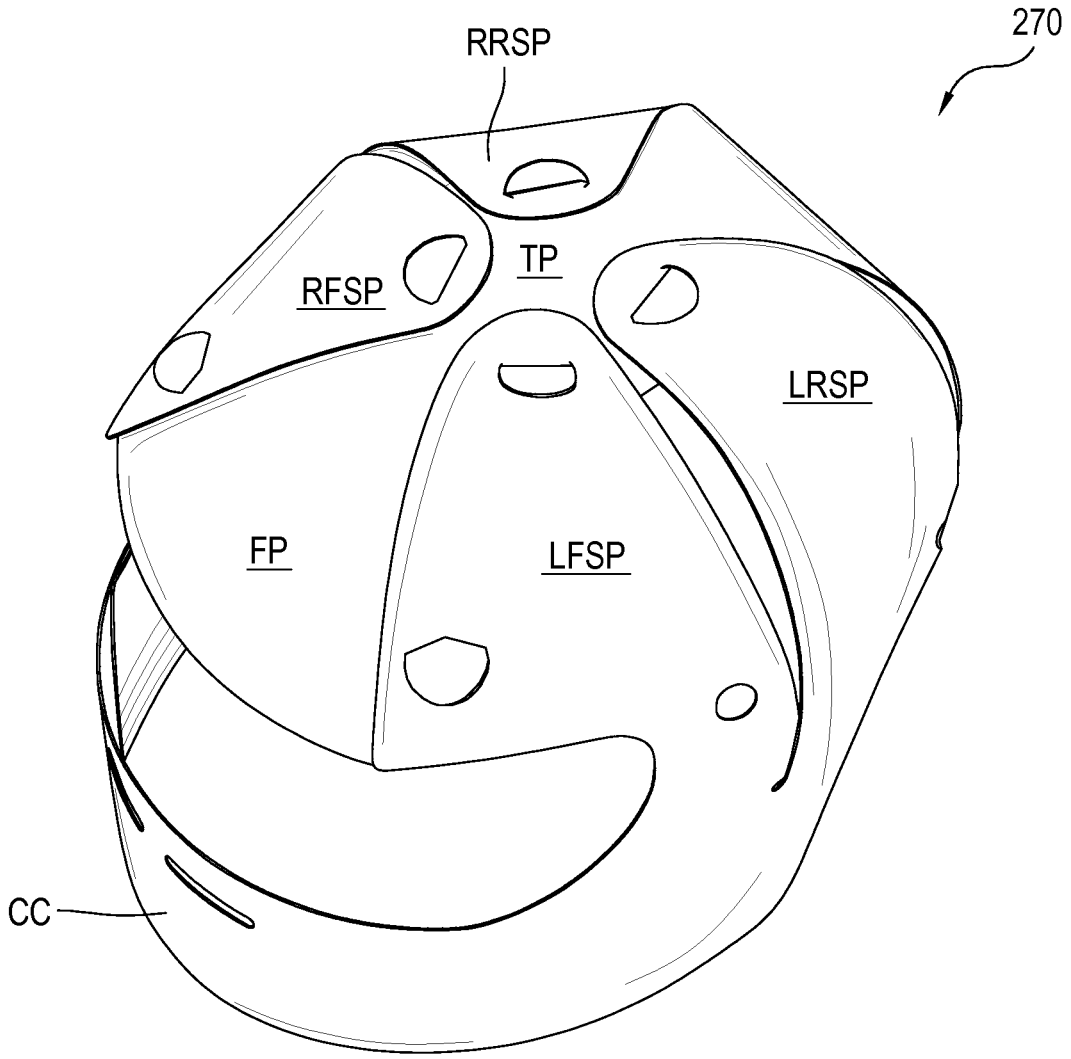
FIG. 17 is a top-front perspective view of the example of FIG. 11.

Optionally, but preferably, front panel FP may have connectors, such as slit/tab interfaces 291, 292 to connect with connectors, such as slit/tab interfaces 253, 262 on the respective front sub-panels (see e.g. FIGS. 11 and 18).

Optionally, but preferably, fold lines, such as beside slits, such as a curve slit at the front 294 of top panel TP (see e.g. FIGS. 16 and 18) may facilitate bending or curving between the top panel and the front panels. Optional slit 220 (see e.g. FIGS. 14 and 18) may do that as between the back panel BP and neck panel NP.

Figure 19:
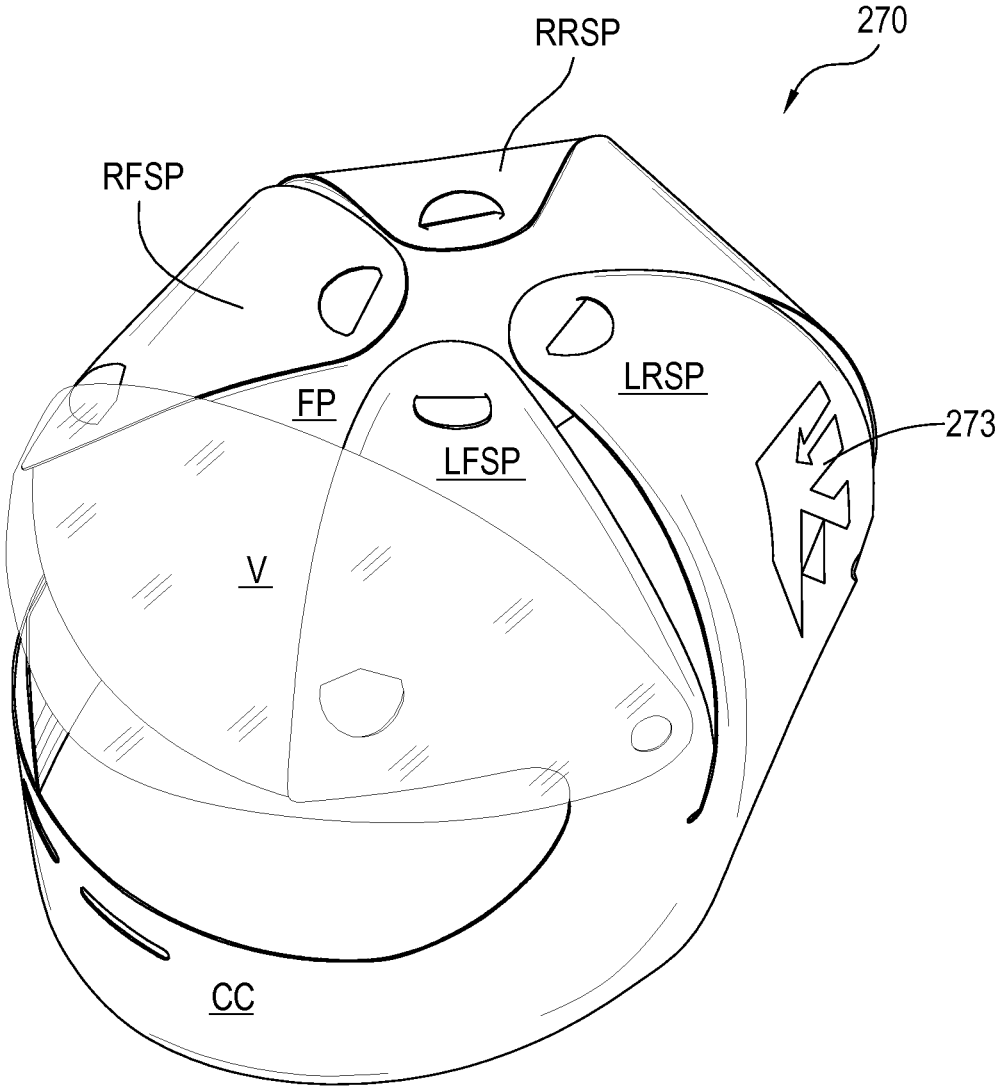
FIG. 19 is a top-front perspective view of the example of FIG. 17 with indicia added.

Optionally, but preferably, headgear 270 includes printed indicia 273 comprising a racing sponsor logo (see FIG. 19). The printed indicia may be printed on at least the RP, LP, BP, TP or any combination of panels.

As used here (claims, specification, and other definitions) the following terms have the following meaning:

Articles and phases such as, "the", "a", "an", "at least one", and "a first", "comprising", "having" and "including" here are not limited to mean only one, but rather are inclusive and open ended to also include, optionally, two or more of such elements and/or other elements. In terms of the meaning of words or terms or phrases herein, literal differences therein are not superfluous and have different meaning, and are not to be synonymous with words or terms or phrases in the same or other claims.

The term "means for" in a claim invokes 35 U.S.C. §112(f), literally encompassing the recited function and corresponding structure and equivalents thereto. Its absence does not, unless there otherwise is insufficient structure recited for that claim element. Nothing herein or elsewhere restricts the doctrine of equivalents available to the patentee.

The term "and/or" is inclusive here, meaning "and" as well as "or". For example, "P and/or Q" encompasses, P, Q, and P with Q; and, such "P and/or Q" may include other elements as well.

In terms of orientation, the front is the face, with top, right, left and back (of the skull) having ordinary meaning. An axis Z is shown (see FIG. 8) which is a vertical axis, from bottom to top.

The term "American-football helmet" as used herein has the meaning, a protective helmet, typically made of plastic and with a facemask on the front as used in American-football (such as, for example, the National Football League (NFL)).

The term "anti-stress riser hole" as used herein has the meaning, a hole, aperture or portion thereof having an edge which is generally curvilinear and without sharp corners.

The term "assembled in three-dimensions" as used herein has the meaning, no longer in two-dimensions, but rather assembled to have a volume.

The term "back panel" (BP) as used herein has the meaning, a portion of a sheet sized, shaped and positioned to cover a majority of the backside of a wear's skull.

The term "bars" as used herein has the meaning, a cage like structure defining gaps there-between.

The term "connector" as used herein has the meaning, of a connecting structure, including without limitation, a slit, hole, hook, notch, tab, projection, peel-off backing adhesive, hook and/or loop (e.g. Velcro™), or otherwise that is user connectable to another such structure or surface or opening on or in the headgear to help hold the thin flexible sheet(s) in the shape simulating an American-football helmet.

The term "converge" as used herein has the meaning, to come together or towards one another.

The term "chin cover" (CC) as used herein has the meaning, a structure that is used to cover the chin for protection or to assist in keeping headgear from being removed from the head.

The term "decorative" as used herein has the meaning, for decorative rather than impact protective use.

The term "diverges" as used herein has the meaning opposite of converge.

The term "ear hole" as used herein has the meaning, an opening in the sheet in either the right or left panel and, greater than about one centimeter across and located over or near the wear's ears.

The term "edge variance" as used herein has the meaning, the absolute value (positive) of the maximum distance, (whether positive or negative), that two edges are, respectively, separated from or overlap each other. Perfectly abutting edges have, at that point, a zero edge variance.

The term "facemask" (FM) as used herein has the meaning, a cage like structure (with or without actual or simulated visor) to cover at least a lower portion of a wear's face while allowing visibility above and/or through it.

The term "folding line" as used herein has the meaning, a pre-existing printed line (straight, dotted, dashed, etc.) and/or pre-existing score, crease or perforations guiding there-along a fold in part of all of a sheet.

The term "football team logo" as used herein has the meaning, any one or more service marks, symbols, images and/or words used to identify a football team.

The term "front panel" (FP) as used herein has the meaning, a portion of a sheet sized, shaped and positioned to cover a portion of the crown of a wear's skull in front of the top side.

The term "generally vertical edge" as used herein includes upwardly-extending edges.

The term "headgear" as used herein has the meaning, an article, such as a helmet, wearable on a person's head.

The term "integral" as used herein has the meaning, made substantially from the same and contiguous sheet material, as opposed for example to two separate parts connected to each other.

The term "in two-dimensions" as used herein has the meaning, when an object, such as a sheet, is flat.

The term "inwardly" as used herein has the meaning, in a direction toward the wearer's skull.

The term "leading generally vertical edge" as used herein has the meaning, a free edge which is positioned toward the face of the wearer relative to the panel or other structure of which the edge is a part.

The term "left front sub-panel" (LFSP) as used herein has the meaning, a panel which makes up a part of the left panel and which is positioned to cover between about one-third to about one two-thirds of the left side of the wear's skull and is generally forward of center.

The term "left rear sub-panel" (LRSP) as used herein has the meaning, a panel which makes up a part of the left panel and which is positioned to cover between about one-third to about one two-thirds of the left side of the wear's skull and is generally rearward of center.

The term "neck panel" (NP) as used herein has the meaning, a portion of a sheet sized, shaped and positioned at or over the interface of the neck and the back of a wear's skull.

The term "plastic" as used herein has the meaning, primarily made of a polymer material, but not including paper or cardboard.

The term "printed indicia" as used herein has the meaning, a image, logo, lettering, numbering, symbol and/or a combination thereof that is laminated in, printed in or on a sheet and is visible.

The term "racing" and "racing helmet" as used herein has the meaning, pertaining to or a helmet for racing vehicles, such as for example cars, motorcycles and/or boats.

The term "right front sub-panel" (RFSP) as used herein has the meaning, a panel which makes up a part of the right panel and which is positioned to cover between about one-third to about one two-thirds of the right side of the wear's skull and is generally forward of center.

The term "right panel" (RP) as used herein has the meaning, a portion of a sheet sized, shaped and positioned to cover a majority of the right side of a wear's skull.

The term "right rear sub-panel" (RRSP) as used herein has the meaning, a panel which makes up a part of the right panel and which is positioned to cover between about one-third to about one two-thirds of the right wear's skull and is generally rearward of center.

The term "separate" as used herein has the meaning, made up of two or more items which are not integral.

The term "sheet" as used herein has the meaning, a single or multi-laminate product, such as made from paper, cardboard, foil, plastic film or a combination thereof.

The term "simulating the appearance" as used herein has the meaning, to look like something else.

The term "slit/tab interfaces" as used herein is a connector formed by a tab with at least one lateral projection adapted to fit and hold in a slit, or a slit for receiving that, cut into or as part of a sheet without further connection structure (i.e. without tape, adhesives, hook and/or loop, metal connector, etc.).

The term "thin flexible material" as used herein has the meaning, less than 0.10 millimeters in thickness and bendable without being brittle.

The term "top panel" (TP) as used herein has the meaning, a portion of a sheet sized, shaped and positioned to cover a majority of the top of a wear's skull.

The term "trailing vertical edge" as used herein has the meaning, a free edge which is positioned away from the face of the wearer relative to the panel or other structure of which the edge is a part.

The term "wearer's" as used herein has the meaning, a human that is or can wear the headgear.

The term "visor" (V) as used herein has the meaning, a structure worn in front of the face to protect a person's eyes. A visor may be clear or semi-transparent to allow a user to see through the visor.

The invention may include any one or more articles or devices made by any of the claimed methods and/or may by different methods but with a claimed composition.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Webster's dictionaries and Random House dictionaries.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. Decorative headgear simulating an appearance of a racing helmet, comprising:

a helmet sheet of thin flexible material, said helmet sheet configurable from a flat, first configuration to a volumetric, second configuration simulating the appearance of a racing helmet, the helmet sheet in said flat, first configuration being shaped to comprise:

(a) a back panel, said back panel partially defined by a back-panel-right upwardly-extending edge and a back-panel-left upwardly-extending edge, wherein in said flat, first configuration said back-panel-right upwardly-extending edge and said back-panel-left upwardly-extending edge converge towards each other bottom to top;

(b) a right panel, wherein said right panel in said flat, first configuration comprises:

(i) a right rear sub-panel, said right rear sub-panel bordering said back panel below said back-panel-right upwardly-extending edge, said right rear sub-panel partially defined by a right-rear-sub-panel-leading upwardly-extending edge and a right-rear-sub-panel-trailing upwardly-extending edge, wherein said right-rear-sub-panel-leading upwardly-extending edge and said right-rear-sub-panel-trailing upwardly-extending edge converge towards each other bottom to top; and, (ii) a right front sub-panel, said right front sub-panel bordering said right rear sub-panel below said right-rear-sub-panel-leading upwardly-extending edge, said right front sub-panel partially defined by a right-front-sub-panel-trailing upwardly-extending edge, wherein said right-front-sub-panel-trailing upwardly-extending edge diverges away from said right-rear-sub-panel-leading upwardly-extending edge bottom to top;

(c) a left panel, wherein said left panel in said flat, first configuration comprises:

(i) a left rear sub-panel, said left rear sub-panel bordering said back panel below said back-panel-left upwardly-extending edge, said left rear sub-panel partially defined by a left-rear-sub-panel-leading upwardly-extending edge and a left-rear-sub-panel-trailing upwardly-extending edge, wherein said left-rear-sub-panel-leading upwardly-extending edge and said left-rear-sub-panel-trailing upwardly-extending edge converge towards each other bottom to top; and, (ii) a left front sub-panel, said left front sub-panel bordering said left rear sub-panel below said left-rear-sub-panel-leading upwardly-extending edge, said left front sub-panel partially defined by a left-front-sub-panel-trailing upwardly-extending edge, wherein said left-front-sub-panel-trailing upwardly-extending edge diverges away from said left-rear-sub-panel-leading upwardly-extending edge bottom to top; and, (d) a top panel;

(e) a front element selected from the group consisting of:

(i) a visor located in front of and above a horizontally-extending viewing opening adapted to be in front of a wearer's eyes when in the volumetric, second configuration; and, (ii) a chin cover, said chin cover defining a lower portion of a horizontally-extending viewing opening adapted to be in front of a wearer's eyes when in the volumetric, second configuration.

2. The headgear of claim 1, wherein said front element comprises both said visor and said chin cover.

3. The headgear of claim 2 wherein said right front sub-panel and said left front sub-panel each have a cutout region partially defining lateral portions of the horizontally-extending viewing opening.

4. The headgear of claim 3, wherein said visor is a sheet of thin flexible material separate from said helmet sheet, and wherein said visor has at left and right sides thereof a slit/tab interface adapted for connection respectively with a slit/tab interface on said right front sub-panel and with a slit/tab interface on said left front sub-panel.

5. The headgear of claim 4, wherein said chin cover is a sheet of thin flexible material integral with and bordering one of said front side panels of said helmet sheet in said flat, first configuration, and wherein said chin cover has a side slit/tab interface adapted for connection respectively with a slit/tab interface on an opposing front side panel.

6. The headgear of claim 5, and further comprising a transparent shield over said horizontal viewing opening.

7. The headgear of claim 6, wherein: (b)(i) said back-panel-right upwardly-extending edge and said right-rear-sub-panel-trailing upwardly-extending edge are each curvilinear, and when said headgear is in said volumetric, second configuration has an edge variance measured from said back-panel-right upwardly-extending edge to said right-rear-sub-panel-trailing upwardly-extending edge not exceeding 10 millimeters; and, (c)(i) said back-panel-left upwardly-extending edge and said left-rear-sub-panel-trailing upwardly-extending edge are each curvilinear, and when said headgear is in said volumetric, second configuration has an edge variance measured from said back-panel-left upwardly-extending edge to said left-rear-sub-panel-trailing upwardly-extending edge not exceeding 10 millimeters.

8. The headgear of claim 7, wherein: (b)(ii) said right-rear-sub-panel-leading upwardly-extending edge and said right-front-sub-panel-trailing upwardly-extending edge are each curvilinear, and when said headgear is in said volumetric, second configuration has an edge variance measured from said right-rear-sub-panel-leading upwardly-extending edge to said right-front-sub-panel-trailing upwardly-extending edge not exceeding 10 millimeters; and, (c)(ii) said left-rear-sub-panel-leading upwardly-extending edge and said left-front-sub-panel-trailing upwardly-extending edge are each curvilinear, and when said headgear is in said volumetric, second configuration has an edge variance measured from said left-rear-sub-panel-leading upwardly-extending edge to said left-front-sub-panel-trailing upwardly-extending edge not exceeding 10 millimeters.

9. The headgear of claim 8, wherein said top panel in the flat, first configuration borders only one of the group consisting of: back panel, right rear sub-panel, right front sub-panel, left rear sub-panel and left front sub-panel.

10. The headgear of claim 9, wherein said headgear is retained in said volumetric, second configuration without any metal connectors.

11. The headgear of claim 10, wherein said top panel has four slit/tab interfaces respectively adapted for connection with slit/tab interfaces at upper portions of a remaining four of said group consisting of: back panel, right rear sub-panel, right front sub-panel, left rear sub-panel and left front sub-panel with which said top panel is not bordering in said flat, first configuration.

12. The headgear of claim 11, wherein said top panel is circular and borders said back panel in said flat, first configuration.

13. The headgear of claim 12, wherein said back panel has a neck panel, said neck panel bordering said back panel along a bottom of said back panel, said neck panel partially defined by a folding line between said back panel and said neck panel, wherein said neck panel is adapted to be folded inwardly and between said back panel and a wearer's neck.

14. The headgear of claim 13, and further comprising a left integral tab bordering said left rear sub-panel and a right integral tab bordering said right rear sub-panel, said left integral tab and said right integral tab each adapted to extend inwardly and between said back panel and said neck panel.

15. The headgear of claim 14, and further comprising printed indicia comprising a racing sponsor logo, said printed indicia on at least said right panel, left panel or both.

16. The headgear of claim 15, wherein: (1) said right-rear-sub-panel-leading upwardly-extending edge and said right-front-sub-panel-trailing upwardly-extending edge converge at a round right side anti-stress riser hole; and, (2) said left-rear-sub-panel-leading upwardly-extending edge and said left-front-sub-panel-trailing upwardly-extending edge converge at a round left side anti-stress riser hole.

17. The headgear of claim 1 wherein said right front sub-panel and said left front sub-panel each have a cutout region partially defining lateral portions of the horizontally-extending viewing opening.

18. The headgear of claim 1, wherein said front element includes said visor and said visor is a sheet of thin flexible material separate from said helmet sheet, and wherein said visor has at left and right sides thereof a slit/tab interface adapted for connection respectively with a slit/tab interface on said right front sub-panel and with a slit/tab interface on said left front sub-panel.

19. The headgear of claim 1, wherein said front element includes said chin cover and said chin cover is a sheet of thin flexible material bordering one of said front side panels of said helmet sheet in said flat, first configuration, and wherein said chin cover has a side slit/tab interface adapted for connection respectively with a slit/tab interface on an opposing front side panel.

20. The headgear of claim 1, and further comprising a transparent shield over said horizontal viewing opening.

21. The headgear of claim 1, wherein: (b)(i) said back-panel-right upwardly-extending edge and said right-rear-sub-panel-trailing upwardly-extending edge are each curvilinear, and when said headgear is in said volumetric, second configuration has an edge variance measured from said back-panel-right upwardly-extending edge to said right-rear-sub-panel-trailing upwardly-extending edge not exceeding 10 millimeters; and, (c)(i) said back-panel-left upwardly-extending edge and said left-rear-sub-panel-trailing upwardly-extending edge are each curvilinear, and when said headgear is in said volumetric, second configuration has an edge variance measured from said back-panel-left upwardly-extending edge to said left-rear-sub-panel-trailing upwardly-extending edge not exceeding 10 millimeters.

22. The headgear of claim 21, wherein: (b)(ii) said right-rear-sub-panel-leading upwardly-extending edge and said right-front-sub-panel-trailing upwardly-extending edge are each curvilinear, and when said headgear is in said volumetric, second configuration has an edge variance measured from said right-rear-sub-panel-leading upwardly-extending edge to said right-front-sub-panel-trailing upwardly-extending edge not exceeding 10 millimeters; and, (c)(ii) said left-rear-sub-panel-leading upwardly-extending edge and said left-front-sub-panel-trailing upwardly-extending edge are each curvilinear, and when said headgear is in said volumetric, second configuration has an edge variance measured from said left-rear-sub-panel-leading upwardly-extending edge to said left-front-sub-panel-trailing upwardly-extending edge not exceeding 10 millimeters.

23. The headgear of claim 1, wherein said top panel in said flat, first configuration borders only one of the group consisting of: back panel, right rear sub-panel, right front sub-panel, left rear sub-panel and left front sub-panel.

24. The headgear of claim 1, wherein the headgear is retained in said volumetric, second configuration without any metal connectors.

25. The headgear of claim 1, wherein said top panel has four slit/tab interfaces respectively adapted for connection with slit/tab interfaces at upper portions of a remaining four of said group consisting of: back panel, right rear sub-panel, right front sub-panel, left rear sub-panel and left front sub-panel with which said top panel is not bordering in said flat, first configuration.

26. The headgear of claim 1, wherein said top panel is circular and borders with said back panel in said flat, first configuration.

27. The headgear of claim 1, wherein said back panel has a neck panel, said neck panel bordering said back panel along a bottom of said back panel, said neck panel partially defined by a folding line between said back panel and said neck panel, wherein said neck panel is adapted to be folded inwardly and between said back panel and a wearer's neck.

28. The headgear of claim 27, and further comprising a left integral tab bordering said left rear sub-panel and a right integral tab bordering said right rear sub-panel, said left integral tab and said right integral tab each adapted to extend inwardly and between said back panel and said neck panel.

29. The headgear of claim 1, and further comprising printed indicia comprising a racing sponsor logo, said printed indicia on at least said right panel, left panel or both.

30. The headgear of claim 1, wherein: (1) said right-rear-sub-panel-leading upwardly-extending edge and said right-front-sub-panel-trailing upwardly-extending edge converge at a round right side anti-stress riser hole; and, (2) said left-rear-sub-panel-leading upwardly-extending edge and said left-front-sub-panel-trailing upwardly-extending edge converge at a round left side anti-stress riser hole.

31. Decorative headgear simulating an appearance of a racing helmet, comprising:

a helmet sheet of thin flexible material, said helmet sheet configurable between a flat, first configuration and a volumetric, second configuration simulating the appearance of a racing helmet, the helmet sheet being shaped to comprise:

(a) a back panel;

(b) a right panel, comprising a right rear sub-panel and a right front sub-panel; and, (c) a left panel, comprising a left rear sub-panel and a left front sub-panel; and, (d) a front element selected from the group consisting of:

(i) a visor located in front of and above a horizontally-extending viewing opening adapted to be in front of a wearer's eyes when in the volumetric, second configuration; and, (ii) a chin cover, said chin cover defining a lower portion of a horizontally-extending viewing opening adapted to be in front of a wearer's eyes when in the volumetric, second configuration;

(e) a top panel, wherein said top panel in the flat, first configuration is not bordering with and has four slit/tab interfaces respectively adapted for connection with slit/tab interfaces at upper portions of said right rear sub-panel, right front sub-panel, left rear sub-panel and left front sub-panel;

wherein said back panel is positioned between said right panel and said left panel in said flat, first configuration.

32. The headgear of claim 31, wherein said front element comprises both said visor and said chin cover.

33. The headgear of claim 31 wherein said right front sub-panel and said left front sub-panel each have a cutout region partially defining lateral portions of the horizontally-extending viewing opening when in the volumetric, second configuration.

34. The headgear of claim 31, wherein said front element comprises said visor and said visor is a sheet of thin flexible material separate from said helmet sheet, and wherein said visor has at left and right sides thereof a slit/tab interface adapted for connection respectively with a slit/tab interface on said right front sub-panel and with a slit/tab interface on said left front sub-panel.

35. The headgear of claim 31, wherein said front element comprises said chin cover and said chin cover is a sheet of thin flexible material integral with and bordering one of said front side panels of said helmet sheet in said flat, first configuration, and wherein said chin cover has a side slit/tab interface adapted for connection respectively with a slit/tab interface on an opposing front side panel.

* * * * *